US009511390B2

(12) United States Patent
Burns

(10) Patent No.: US 9,511,390 B2
(45) Date of Patent: Dec. 6, 2016

(54) SUBSTANCE DISPENSING SYSTEM

(71) Applicant: Rooftop Research, LLC, New Wilmington, PA (US)

(72) Inventor: Robert S. Burns, New Wilmington, PA (US)

(73) Assignee: Rooftop Research, LLC, New Wilmington, PA (US)

( * ) Notice: Subject to any disclaimer, the term of this patent is extended or adjusted under 35 U.S.C. 154(b) by 0 days.

(21) Appl. No.: 14/620,848

(22) Filed: Feb. 12, 2015

(65) Prior Publication Data

US 2015/0151324 A1 Jun. 4, 2015

Related U.S. Application Data

(63) Continuation of application No. 13/837,504, filed on Mar. 15, 2013, now Pat. No. 8,998,040.

(51) Int. Cl.

| | |
|---|---|
| ***F15B 1/26*** | (2006.01) |
| ***B05C 5/02*** | (2006.01) |
| ***F15B 15/00*** | (2006.01) |
| ***F04B 9/105*** | (2006.01) |
| ***F15B 13/02*** | (2006.01) |

(52) U.S. Cl.

CPC ..... *B05C 5/0237* (2013.01); *F04B 9/105* (2013.01); *F04B 9/1053* (2013.01); *F15B 1/26* (2013.01); *F15B 13/024* (2013.01); *F15B 15/00* (2013.01)

(58) Field of Classification Search

CPC ..... B05C 5/0237; F15B 1/26; F15B 13/024; F15B 15/00; F04B 9/1053; F04B 9/105

USPC ..... 222/334, 386, 326, 325, 389, 384, 262, 222/63

See application file for complete search history.

(56) References Cited

U.S. PATENT DOCUMENTS

| | | | | |
|---|---|---|---|---|
| 2,752,075 | A | | 6/1956 | Hill |
| 3,288,333 | A | | 11/1966 | Valk, Jr. |
| 3,767,078 | A | | 10/1973 | Gortz et al. |
| 3,791,557 | A | | 2/1974 | Venus, Jr. |
| 4,201,318 | A | * | 5/1980 | Adams ..... B05C 17/015 222/324 |
| 4,212,413 | A | * | 7/1980 | Barber, Jr. ..... C03C 27/06 222/1 |
| 4,334,636 | A | * | 6/1982 | Paul ..... G01F 11/04 222/326 |
| 4,355,734 | A | | 10/1982 | Moore |
| 4,749,337 | A | | 6/1988 | Dickinson et al. |
| 4,830,230 | A | * | 5/1989 | Powers ..... G01F 3/065 222/334 |
| 5,238,147 | A | | 8/1993 | Yasui et al. |
| 5,312,028 | A | | 5/1994 | Hume |
| 5,346,476 | A | | 9/1994 | Elson |
| 5,390,825 | A | * | 2/1995 | Rockel ..... C10M 171/008 222/135 |

(Continued)

*Primary Examiner* — Kevin P Shaver
*Assistant Examiner* — Robert Nichols, II
(74) *Attorney, Agent, or Firm* — The Webb Law Firm

(57) ABSTRACT

A substance dispensing system that includes a hydraulic drive system is disclosed. The hydraulic drive system includes a hydraulic valve having a variable pressure setting, the hydraulic valve operable between a closed position in which a hydraulic pump moves hydraulic fluid to a hydraulic cylinder and an open position in which the hydraulic pump moves the hydraulic fluid to a hydraulic reservoir. The substance dispensing system of the present disclosure provides a system that recirculates hydraulic fluid in a hydraulic drive system instead of recirculating a substance back to a container via a pump. The substance dispensing system of the present disclosure allows for precise, accurate, and instantaneous control of an external force in a substance dispensing system.

15 Claims, 16 Drawing Sheets

(56) References Cited

U.S. PATENT DOCUMENTS

| | | | | |
|---|---|---|---|---|
| 5,411,180 | A | 5/1995 | Dumelle | |
| 5,755,361 | A | 5/1998 | Restive et al. | |
| 5,799,827 | A | 9/1998 | D'Andrade | |
| 5,881,914 | A * | 3/1999 | Tsuda | B05C 11/10 222/146.5 |
| 5,882,691 | A | 3/1999 | Conboy | |
| 5,984,199 | A | 11/1999 | Restive | |
| 6,257,448 | B1 | 7/2001 | D'Andrade et al. | |
| 6,267,999 | B1 * | 7/2001 | Romer | B05C 17/002 118/24 |
| 6,308,868 | B1 | 10/2001 | Hoffman et al. | |
| 6,328,715 | B1 | 12/2001 | Dragan et al. | |
| 6,412,707 | B1 | 7/2002 | Wirz | |
| 6,595,392 | B2 | 7/2003 | Barnett | |
| 6,662,969 | B2 | 12/2003 | Peeler et al. | |
| 7,056,556 | B2 | 6/2006 | Burns | |
| 8,342,372 | B2 | 1/2013 | Choiniere et al. | |
| 2008/0000928 | A1 | 1/2008 | Choiniere et al. | |
| 2011/0081499 | A1 | 4/2011 | Parks et al. | |
| 2011/0259912 | A1 | 10/2011 | Choiniere et al. | |
| 2011/0259919 | A1 | 10/2011 | Choiniere et al. | |
| 2012/0012054 | A1 | 1/2012 | Galvin et al. | |
| 2012/0042826 | A1 | 2/2012 | Galvin et al. | |
| 2012/0074167 | A1 | 3/2012 | Galvin et al. | |
| 2012/0181301 | A1 | 7/2012 | Choiniere et al. | |
| 2013/0008376 | A1 | 1/2013 | Snowwhite et al. | |

* cited by examiner 106
104
114, 120
100
108
112
114, 118
114, 116
110
94
105
102
10
B
A
109
107
150
62
74
16, 70
40
50
14, 44
42
96

SUBSTANCE DISPENSING SYSTEM

CROSS-REFERENCE TO RELATED APPLICATION

The present application claims priority to U.S. application Ser. No. 13/837,504 entitled "Substance Dispensing System", filed Mar. 15, 2013, the entire disclosure of which is hereby expressly incorporated by reference herein.

BACKGROUND OF THE INVENTION

1. Field of the Disclosure

The present disclosure relates generally to a substance dispensing system. More particularly, the present disclosure relates to a hydraulic drive system for a dispensing system for expelling a substance from a container.

2. Description of the Related Art

Force generation systems produce a force which acts on a container holding a substance to dispense the substance from the container. Force generation systems need to be able to stop a flow of the substance when desired. When existing force generation systems, such as electrical wired or wireless systems, are stopped, the flow of a substance is likely to continue flowing and will undesirably exit a hose or channel after it is desired for the flow of the substance to stop because the feedback between the system, such as a transmitter and a receiver, produces a time delay. Such a time delay in existing force generation systems causes significant portions of the substance to be wasted and results in messy leaks that cause problems to the desired application of the substance. Additionally, such force generation systems require controls that need to be held in the hand of an operator which is undesirable.

Furthermore, when existing force generation systems are stopped, the system may use a pump to recirculate a substance back to the container via the pump. In such systems, the pump is in fluid communication with the substance to be dispensed. Disadvantageously, the substance being in contact with the pump causes the components of the pump to need to be disposed of or cleaned prior to use with another substance. Even in instances where the same substance is to be used again, the substance left in the components of the pump can cure inside channels, chambers, and other moving parts of the pump to cause significant delays in the dispensing process and/or ruin expensive parts.

SUMMARY OF THE INVENTION

The present disclosure provides a substance dispensing system that includes a hydraulic drive system having a hydraulic pressure and a substance containment system in communication with the hydraulic drive system. In one embodiment, the hydraulic drive system includes a hydraulic valve having a variable pressure setting, the hydraulic valve operable between a closed position in which a hydraulic pump moves hydraulic fluid to a hydraulic cylinder and an open position in which the hydraulic pump moves the hydraulic fluid to a hydraulic reservoir. In one embodiment, the substance containment system includes a container adapted to hold a substance, the substance contained within the container at a substance pressure, and an actuation member in communication with the hydraulic cylinder, the actuation member movable between a first position and a second position. With the actuation member in the first position and the hydraulic pump activated, the hydraulic pump moves the hydraulic fluid to the hydraulic cylinder to actuate the hydraulic cylinder which advances the actuation member from the first position towards the second position, and as the actuation member moves from the first position towards the second position, the actuation member deforms the container thereby expelling the substance from the container. The substance containment system also includes interruption means for stopping flow of the substance from the container to provide a resistance that resists movement of the actuation member and the hydraulic cylinder thereby increasing the hydraulic pressure of the hydraulic drive system, and when the hydraulic pressure reaches the variable pressure setting, the hydraulic valve moves to the open position in which the hydraulic pump moves the hydraulic fluid to the hydraulic reservoir thereby relieving the hydraulic fluid pumped to the hydraulic cylinder and stopping movement of the hydraulic cylinder and the actuation member.

The substance dispensing system of the present disclosure provides a system that recirculates hydraulic fluid in a hydraulic drive system instead of recirculating a substance back to a container via a pump. The substance dispensing system of the present disclosure allows for precise, accurate, and instantaneous control of an external force in a substance dispensing system. For example, the substance dispensing system of the present disclosure allows for movement of the hydraulic cylinder and the actuation member to be stopped instantaneously for precise and accurate substance flow stoppage. Additionally, the substance dispensing system of the present disclosure provides a system that can be operated from a distal location from a force generation mechanism and with no controls of the force generation system in the hand of an operator.

In accordance with an embodiment of the present disclosure, a substance dispensing system includes a hydraulic drive system having a hydraulic pressure, the hydraulic drive system including a hydraulic cylinder; a hydraulic reservoir containing a hydraulic fluid; a hydraulic pump in fluid communication with the hydraulic reservoir, the hydraulic pump operable to move the hydraulic fluid to the hydraulic cylinder; and a hydraulic valve having a variable pressure setting, the hydraulic valve operable between a closed position in which the hydraulic pump moves the hydraulic fluid to the hydraulic cylinder and an open position in which the hydraulic pump moves the hydraulic fluid to the hydraulic reservoir. The substance dispensing system further includes a substance containment system in communication with the hydraulic cylinder of the hydraulic drive system, the substance containment system including a container having a first end, a second end, and a deformable wall extending therebetween and defining a container interior adapted to hold a substance, the substance contained within the container at a substance pressure; an actuation member movably positionable relative to the container, the actuation member in communication with the hydraulic cylinder, the actuation member movable between a first position in which the actuation member is adjacent the first end of the container and a second position in which the actuation member is adjacent the second end of the container; and a dispensing valve in communication with the container, the dispensing valve operable between an open position in which the substance is able to flow out the container and a closed position in which the substance is maintained within the container; wherein, with the actuation member in the first position and the hydraulic pump activated, the hydraulic pump moves the hydraulic fluid to the hydraulic cylinder to actuate the hydraulic cylinder which advances the actuation member from the first position towards the second position, with the dispensing valve in the open position, as the actuation member moves from the first position towards the second position, the actuation member deforms the container thereby expelling the substance from the container, and with the dispensing valve in the closed position, the substance pressure increases and provides a resistance that resists movement of the actuation member and the hydraulic cylinder thereby increasing the hydraulic pressure of the hydraulic drive system, and when the hydraulic pressure reaches the variable pressure setting, the hydraulic valve moves to the open position in which the hydraulic pump moves the hydraulic fluid to the hydraulic reservoir thereby relieving the hydraulic fluid pumped to the hydraulic cylinder and stopping movement of the hydraulic cylinder and the actuation member.

In one configuration, moving the dispensing valve from the closed position to the open position allows the substance to flow out the container and reduces the substance pressure which decreases the hydraulic pressure of the hydraulic drive system, and when the hydraulic pressures drops below the variable pressure setting, the hydraulic valve moves to the closed position in which the hydraulic pump moves the hydraulic fluid to the hydraulic cylinder to actuate the hydraulic cylinder which advances the actuation member towards the second position. In another configuration, the substance containment system further includes a confinement structure having a proximal end, a distal end, and a sidewall extending therebetween and defining an interior, the container sized to be positionable within the interior of the confinement structure, and the actuation member movably positionable within the confinement structure, with the container positioned within the confinement structure, the actuation member is movable between the first position in which the actuation member is adjacent the proximal end of the confinement structure and the second position in which the actuation member is adjacent the distal end of the confinement structure; and wherein, with the container positioned within the confinement structure and the hydraulic pump activated, the hydraulic pump moves the hydraulic fluid to the hydraulic cylinder to actuate the hydraulic cylinder which advances the actuation member from the first position towards the second position, with the dispensing valve in the open position, as the actuation member moves from the first position towards the second position, the actuation member deforms the container thereby expelling the substance from the container, and with the dispensing valve in the closed position, the substance pressure increases and provides the resistance that resists movement of the actuation member and the hydraulic cylinder thereby increasing the hydraulic pressure of the hydraulic drive system, and when the hydraulic pressure reaches the variable pressure setting, the hydraulic valve moves to the open position in which the hydraulic pump moves the hydraulic fluid to the hydraulic reservoir thereby relieving the hydraulic fluid pumped to the hydraulic cylinder and stopping movement of the hydraulic cylinder and the actuation member. In yet another configuration, placing the dispensing valve in the closed position instantaneously stops movement of the hydraulic cylinder and the actuation member.

In one configuration, the actuation member includes a plunger. In another configuration, the hydraulic drive system further includes a hydraulic motor, the hydraulic pump drivingly connected to the hydraulic motor. In yet another configuration, the variable pressure setting of the hydraulic valve is set to a predetermined setting. In one configuration, the variable pressure setting can be set at a variety of different setting values. In another configuration, the substance dispensing system further includes a hose in communication with the second end of the container. In yet another configuration, the substance dispensing system further includes a nozzle in communication with the second end of the container. In one configuration, the hydraulic cylinder includes a double acting cylinder operable in both a forward direction and a reverse direction. In another configuration, the substance is a non-compressible fluid. In yet another configuration, the substance is an adhesive. In one configuration, the substance is a coating. In another configuration, the substance is a caulking. In yet another configuration, the substance dispensing system further includes a second hydraulic cylinder, and with the actuation member in the first position and the hydraulic pump activated, the hydraulic pump moves the hydraulic fluid to the hydraulic cylinder to actuate the hydraulic cylinder and simultaneously moves the hydraulic fluid at a first end of the hydraulic cylinder to an end of the second hydraulic cylinder such that the second hydraulic cylinder moves concurrently with the hydraulic cylinder to advance the actuation member from the first position towards the second position.

In accordance with another embodiment of the present disclosure, a substance dispensing system includes a hydraulic drive system having a hydraulic pressure, the hydraulic drive system including a hydraulic cylinder; a hydraulic reservoir containing a hydraulic fluid; a hydraulic pump in fluid communication with the hydraulic reservoir, the hydraulic pump operable to move the hydraulic fluid to the hydraulic cylinder; and a hydraulic valve having a variable pressure setting, the hydraulic valve operable between a closed position in which the hydraulic pump moves the hydraulic fluid to the hydraulic cylinder and an open position in which the hydraulic pump moves the hydraulic fluid to the hydraulic reservoir. The substance dispensing system further includes a substance containment system in communication with the hydraulic cylinder of the hydraulic drive system, the substance containment system including a container having a first end, a second end, and a deformable wall extending therebetween and defining a container interior adapted to hold a substance, the substance contained within the container at a substance pressure; an actuation member movably positionable relative to the container, the actuation member in communication with the hydraulic cylinder, the actuation member movable between a first position in which the actuation member is adjacent the first end of the container and a second position in which the actuation member is adjacent the second end of the container, with the actuation member in the first position and the hydraulic pump activated, the hydraulic pump moves the hydraulic fluid to the hydraulic cylinder to actuate the hydraulic cylinder which advances the actuation member from the first position towards the second position, as the actuation member moves from the first position towards the second position, the actuation member deforms the container thereby expelling the substance from the container; and interruption means for stopping flow of the substance from the container to provide a resistance that resists movement of the actuation member and the hydraulic cylinder thereby increasing the hydraulic pressure of the hydraulic drive system, and when the hydraulic pressure reaches the variable pressure setting, the hydraulic valve moves to the open position in which the hydraulic pump moves the hydraulic fluid to the hydraulic reservoir thereby relieving the hydraulic fluid pumped to the hydraulic cylinder and stopping movement of the hydraulic cylinder and the actuation member.

In one configuration, the interruption means includes a dispensing valve in communication with the container, the dispensing valve operable between an open position in which the substance is able to flow out the container and a closed position in which the substance is maintained within the container, with the dispensing valve in the open position, as the actuation member moves from the first position towards the second position, the actuation member deforms the container thereby expelling the substance from the container, and with the dispensing valve in the closed position, the substance pressure increases and provides the resistance that resists movement of the actuation member and the hydraulic cylinder thereby increasing the hydraulic pressure of the hydraulic drive system. In another configuration, moving the dispensing valve from the closed position to the open position allows the substance to flow out the container and reduces the substance pressure thereby decreasing the hydraulic pressure of the hydraulic drive system, and when the hydraulic pressures drops below the variable pressure setting, the hydraulic valve moves to the closed position in which the hydraulic pump moves the hydraulic fluid to the hydraulic cylinder to actuate the hydraulic cylinder which advances the actuation member towards the second position. In yet another configuration, the substance containment system further includes a confinement structure having a proximal end, a distal end, and a sidewall extending therebetween and defining an interior, the container sized to be positionable within the interior of the confinement structure, and the actuation member movably positionable within the confinement structure, with the container positioned within the confinement structure, the actuation member is movable between the first position in which the actuation member is adjacent the proximal end of the confinement structure and the second position in which the actuation member is adjacent the distal end of the confinement structure; and wherein, with the container positioned within the confinement structure and the hydraulic pump activated, the hydraulic pump moves the hydraulic fluid to the hydraulic cylinder to actuate the hydraulic cylinder which advances the actuation member from the first position towards the second position, with the dispensing valve in the open position, as the actuation member moves from the first position towards the second position, the actuation member deforms the container thereby expelling the substance from the container, and with the dispensing valve in the closed position, the substance pressure increases and provides the resistance that resists movement of the actuation member and the hydraulic cylinder thereby increasing the hydraulic pressure of the hydraulic drive system, and when the hydraulic pressure reaches the variable pressure setting, the hydraulic valve moves to the open position in which the hydraulic pump moves the hydraulic fluid to the hydraulic reservoir thereby relieving the hydraulic fluid pumped to the hydraulic cylinder and stopping movement of the hydraulic cylinder and the actuation member. In one configuration, placing the dispensing valve in the closed position instantaneously stops movement of the hydraulic cylinder and the actuation member. In another configuration, the interruption means includes a clog in the substance containment system, wherein the clog increases the substance pressure to provide the resistance that resists movement of the actuation member and the hydraulic cylinder thereby increasing the hydraulic pressure of the hydraulic drive system. In another configuration, the actuation member includes a plunger.

In accordance with another embodiment of the present disclosure, a substance dispensing system includes a hydraulic drive system having a hydraulic pressure, the hydraulic drive system including a hydraulic cylinder; a hydraulic reservoir containing a hydraulic fluid; a hydraulic pump in fluid communication with the hydraulic reservoir, the hydraulic pump operable to move the hydraulic fluid to the hydraulic cylinder; and a hydraulic valve having a variable pressure setting, the hydraulic valve operable between a closed position in which the hydraulic pump moves the hydraulic fluid to the hydraulic cylinder and an open position in which the hydraulic pump moves the hydraulic fluid to the hydraulic reservoir. The substance dispensing system further includes a substance containment system in communication with the hydraulic cylinder of the hydraulic drive system, the substance containment system including a substance located relative to an exit portion, the substance movable out the exit portion, the substance having a substance pressure; an actuation member movably positionable relative to the substance, the actuation member in communication with the hydraulic cylinder, the actuation member movable between a first position in which the actuation member is adjacent the substance and a second position in which the actuation member is in contact with the substance and forces the substance out the exit portion, with the actuation member in the first position and the hydraulic pump activated, the hydraulic pump moves the hydraulic fluid to the hydraulic cylinder to actuate the hydraulic cylinder which advances the actuation member from the first position towards the second position, as the actuation member moves from the first position towards the second position, the actuation member contacts the substance thereby expelling the substance from the exit portion; and interruption means for stopping flow of the substance from the container to provide a resistance that resists movement of the actuation member and the hydraulic cylinder thereby increasing the hydraulic pressure of the hydraulic drive system, and when the hydraulic pressure reaches the variable pressure setting, the hydraulic valve moves to the open position in which the hydraulic pump moves the hydraulic fluid to the hydraulic reservoir thereby relieving the hydraulic fluid pumped to the hydraulic cylinder and stopping movement of the hydraulic cylinder and the actuation member.

In one configuration, the substance dispensing system further includes a substance housing having a first end, a second end, and a wall extending therebetween and defining an interior adapted to hold the substance, the substance contained within the substance housing at the substance pressure. In another configuration, the exit portion is located at the second end of the substance housing. In yet another configuration, the actuation member is movably positionable relative to the substance housing, with the actuation member in the first position, the actuation member is adjacent the first end of the substance housing, and with the actuation member in the second position, the actuation member is adjacent the second end of the substance housing. In one configuration, with the actuation member in the second position, the substance is completely expelled out the exit portion. In another configuration, as the actuation member moves from the first position towards the second position, the actuation member is movably received within the interior of the substance housing and is in contact with the substance. In yet another configuration, the actuation member includes a plunger.

In accordance with another embodiment of the present disclosure, a substance dispensing system includes a drive system having a pressure, the drive system including an actuation member; a reservoir containing a fluid; a supply line in fluid communication with the actuation member and the reservoir; a relief line in fluid communication with the reservoir; and a valve having a variable pressure setting, the valve operable between a closed position in which the drive system moves the fluid to the actuation member via the supply line thereby actuating the actuation member and an open position in which the drive system recirculates the fluid to the reservoir via the relief line thereby relieving the fluid moved to the actuation member and stopping movement of the actuation member. The substance dispensing system further includes a substance containment system in communication with the actuation member of the drive system, the substance containment system including a container adapted to hold a substance, wherein the substance is contained within the container at a substance pressure, and wherein the actuation member is movably positionable relative to the container.

In one configuration, the substance containment system includes a dispensing valve in communication with the container, the dispensing valve operable between an open position in which the substance is able to flow out the container and a closed position in which the substance is maintained within the container. In another configuration, the container includes a first end and a second end, and the actuation member is movable between a first position in which the actuation member is adjacent the first end of the container and a second position in which the actuation member is adjacent the second end of the container. In yet another configuration, with the actuation member in the first position and the drive system activated, the drive system moves the fluid to the actuation member via the supply line to actuate the actuation member which advances the actuation member from the first position towards the second position, with the dispensing valve in the open position, as the actuation member moves from the first position towards the second position, the actuation member deforms the container thereby expelling the substance from the container, and with the dispensing valve in the closed position, the substance pressure increases and provides a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member. In one configuration, moving the dispensing valve from the closed position to the open position allows the substance to flow out the container and reduces the substance pressure which decreases the pressure of the drive system, and when the pressures drops below the variable pressure setting, the valve moves to the closed position in which the drive system moves the fluid to the actuation member via the supply line to actuate the actuation member which advances the actuation member towards the second position. In another configuration, placing the dispensing valve in the closed position instantaneously stops movement of the actuation member. In yet another configuration, the substance containment system includes an interruption means for stopping flow of the substance from the container to provide a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member.

In accordance with another embodiment of the present disclosure, a substance dispensing system includes a drive system having a pressure, the drive system including an actuation member; a reservoir containing a fluid; a supply line in fluid communication with the actuation member and the reservoir; a relief line in fluid communication with the reservoir; and a valve having a variable pressure setting, the valve operable between a closed position in which the drive system moves the fluid to the actuation member via the supply line thereby actuating the actuation member and an open position in which the drive system recirculates the fluid to the reservoir via the relief line thereby relieving the fluid moved to the actuation member and stopping movement of the actuation member. The substance dispensing system further includes a substance containment system in communication with the actuation member of the drive system, the substance containment system including a substance located relative to an exit portion, the substance movable out the exit portion, the substance having a substance pressure, wherein the actuation member is movably positionable relative to the substance.

In one configuration, the actuation member is movable between a first position in which the actuation member is adjacent the substance and a second position in which the actuation member is in contact with the substance and forces the substance out the exit portion, with the actuation member in the first position and the drive system activated, the drive system moves the fluid to the actuation member via the supply line to actuate the actuation member which advances the actuation member from the first position towards the second position, as the actuation member moves from the first position towards the second position, the actuation member contacts the substance thereby expelling the substance from the exit portion. In another configuration, the substance containment system includes an interruption means for stopping flow of the substance from the substance containment system to provide a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member. In yet another configuration, the substance dispensing system includes a substance housing having a first end, a second end, and a wall extending therebetween and defining an interior adapted to hold the substance, the substance contained within the substance housing at the substance pressure. In one configuration, the exit portion is located at the second end of the substance housing. In another configuration, the actuation member is movably positionable relative to the substance housing, with the actuation member in the first position, the actuation member is adjacent the first end of the substance housing, and with the actuation member in the second position, the actuation member is adjacent the second end of the substance housing. In yet another configuration, with the actuation member in the second position, the substance is completely expelled out the exit portion. In one configuration, as the actuation member moves from the first position towards the second position, the actuation member is movably received within the interior of the substance housing and is in contact with the substance.

BRIEF DESCRIPTION OF THE DRAWINGS

The above-mentioned and other features and advantages of this disclosure, and the manner of attaining them, will become more apparent and the disclosure itself will be better understood by reference to the following descriptions of embodiments of the disclosure taken in conjunction with the accompanying drawings, wherein.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1:
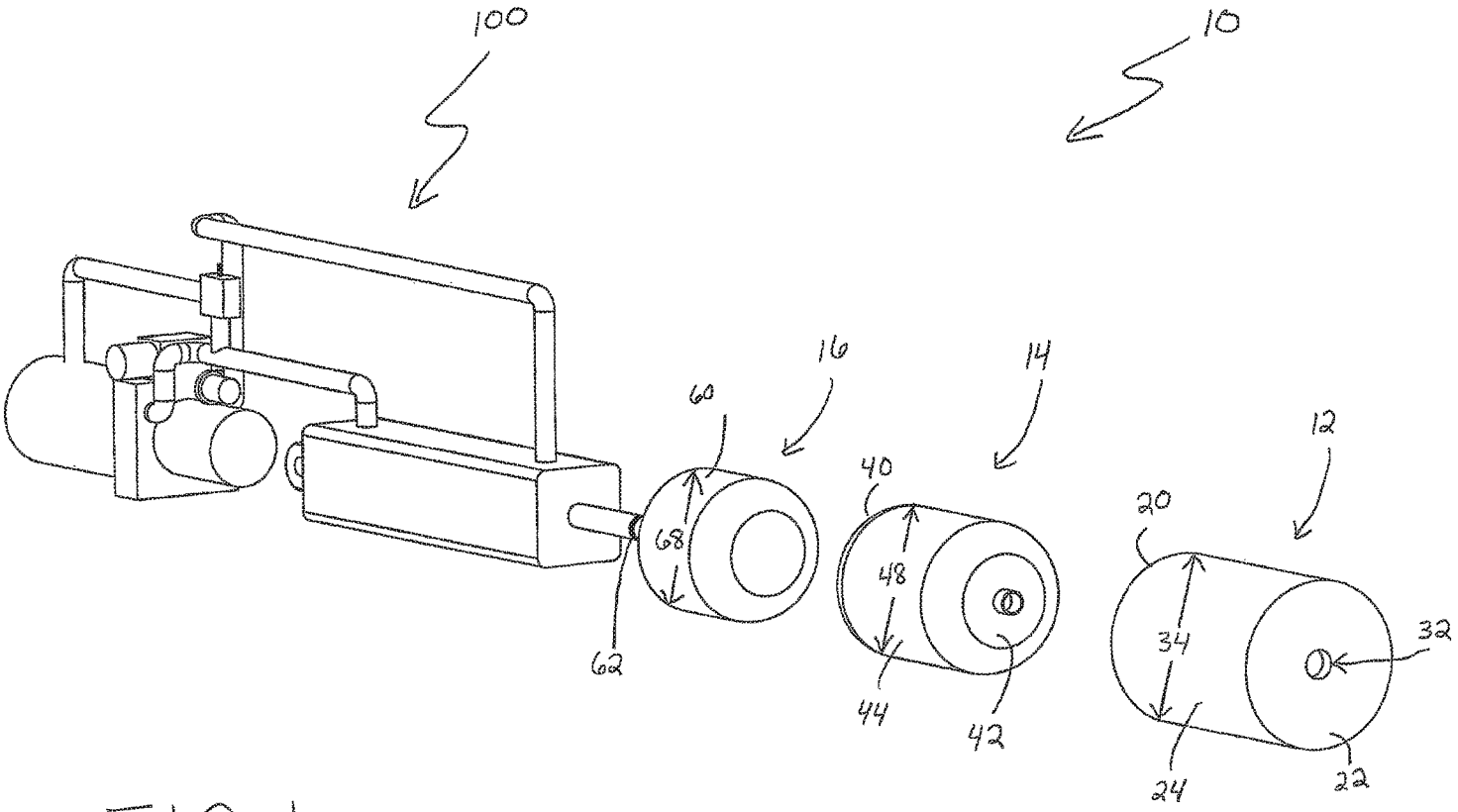
FIG. 1 is an exploded, perspective view of a substance dispensing system in accordance with an embodiment of the present invention.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

In the following discussion, "distal" refers to a direction generally toward a portion of a substance dispensing system in which a substance is expelled from a container, and "proximal" refers to the opposite direction of distal, i.e., away from the portion of the substance dispensing system in which a substance is expelled from a container. For purposes of this disclosure, the above-mentioned references are used in the description of the components of a substance dispensing system in accordance with the present disclosure.

FIGS. 1-16 illustrate exemplary embodiments of the present disclosure. Referring to FIGS. 1-10, substance dispensing system 10 includes confinement structure 12, container 14, actuation member 16, frame 80, and hydraulic drive system 100 as will be described in more detail below. Substance dispensing system 10 provides a system that recirculates hydraulic fluid in a hydraulic drive system 100 instead of recirculating a substance back to a container via a pump. Substance dispensing system 10 of the present disclosure allows for precise, accurate, and instantaneous control of an external force in a substance dispensing system. For example, substance dispensing system 10 of the present disclosure allows for movement of a hydraulic cylinder 102 and actuation member 16 to be stopped instantaneously for precise and accurate substance flow stoppage. Additionally, substance dispensing system 10 of the present disclosure provides a system that can be operated from a distal location from a force generation mechanism and with no controls of the force generation system in the hand of an operator. Substance dispensing system 10 also provides a more efficient process of dispensing a substance from a container.

In the exemplary embodiments of FIGS. 1-16, confinement structure 12, container 14, and actuation member 16 are illustrated as elongated cylindrical members, though it is contemplated that other shapes and sizes of these components may be used. For example, confinement structure 12, container 14, and actuation member 16 can have other multi-sided polygon cross-sectional shapes, such as square, rectangular, or triangular cross-sectional shapes. Container 14 may also be available in a variety of shapes and sizes to accommodate a variety of substances as will be discussed in more detail below.

Referring to FIGS. 1-14, confinement structure 12 includes proximal end 20, distal end 22, and sidewall 24 extending between proximal end 20 and distal end 22. Referring to FIGS. 3-9, sidewall 24 of confinement structure 12 defines an interior 26 sized and shaped to receive container 14 and actuation member 16 as will be described in more detail below. In one embodiment, proximal end 20 of confinement structure 12 includes an open end and distal end 22 of confinement structure 12 includes an exit portion or exit aperture 32. Referring to FIG. 1, proximal end 20 of confinement structure 12 defines a confinement structure diameter 34. In one embodiment, confinement structure diameter 34 is defined by interior wall surface 30 of confinement structure 12. In this manner, proximal end 20 of confinement structure 12 defines an interior confinement structure diameter 34 as shown in FIG. 1.

Referring to FIGS. 1-9, container 14 includes first end 40, second end 42, and a deformable wall 44 extending between first end 40 and second end 42. Referring to FIGS. 4-9, deformable wall 44 of container 14 defines a container interior 46 adapted to hold a substance 50. Container 14 is adapted to hold a variety of different substances. For example, container 14 is adapted to hold various non-compressible fluids, adhesives, coatings, putties, and caulkings for a variety of different applications. Some one part and multiple component products which could be used with the present disclosure include noiseproofing compounds, glazing adhesives and sealants, chinking compounds, solar glass sealants, self leveling sealants, composite construction adhesives coatings and compounds, flooring adhesives, roofing adhesives, roof coatings, masonry tuck pointing, mechanical equipment adhesives, architectural metal sealant, marine adhesives and coatings, waterproofing compounds, siding sealants, fabric adhesives, leather adhesives, vinyl adhesives, wood construction adhesives, wallpaper adhesives, firestopping adhesives and caulkings, silicone, grease, architectural railing systems, guardrail systems, automotive sealants and adhesives, manufacturing processes, door and window adhesives and sealants, EIFS adhesives and sealants, flooring sealants, truck bed liners, epoxies, rust proofing, para-methoxy-n-methylamphetamine (PMMA), acrylic caulkings, and polyurethane foam insulation. It is also contemplated that other substances such as foodstuffs could be used with the present disclosure.

Container 14 is sized and shaped to be positionable within interior 26 of confinement structure 12 as shown in FIGS. 4-9. Referring to FIG. 1, first end 40 of container 14 defines a container diameter 48. Container 14 has a tear resistance sufficient to withstand tearing during a controlled deformation process.

Referring to FIGS. 1-14, actuation member 16 includes head portion 60 and shaft portion 62. Actuation member 16 may be slidably or movably positionable within confinement structure 12. Referring to FIGS. 4-9, in one embodiment, head portion 60 of actuation member 16 is sized and shaped to contact first end 40 of container 14 to deform container 14 to expel substance 50 from container 14 as will be discussed in more detail below. Referring to FIGS. 11-14, in another embodiment, head portion 60 of actuation member 16 is sized and shaped to contact substance 50 and force substance 50 out an exit portion 212 as will be discussed in more detail below.

Shaft portion 62 of actuation member 16 is adapted to be placed in communication with a drive system for advancing actuation member 16 within confinement structure 12 between a first position (FIG. 4) in which actuation member 16 is adjacent first end 40 of container 14 and a second position (FIG. 7) in which actuation member 16 is adjacent second end 42 of container 14. In this manner, with container 14 positioned within confinement structure 12, as actuation member 16 moves from the first position towards the second position, actuation member 16 deforms container 14 thereby expelling substance 50 from container 14. In one embodiment, the drive system may be a hydraulic drive system 100 as will be discussed below. However, it is envisioned that other drive systems may be used. For example, the drive system could include other mechanical and electrical drive systems. For example, referring to FIG. 16 substance dispensing system 300 may include an electrical drive system 302.

Figure 16:
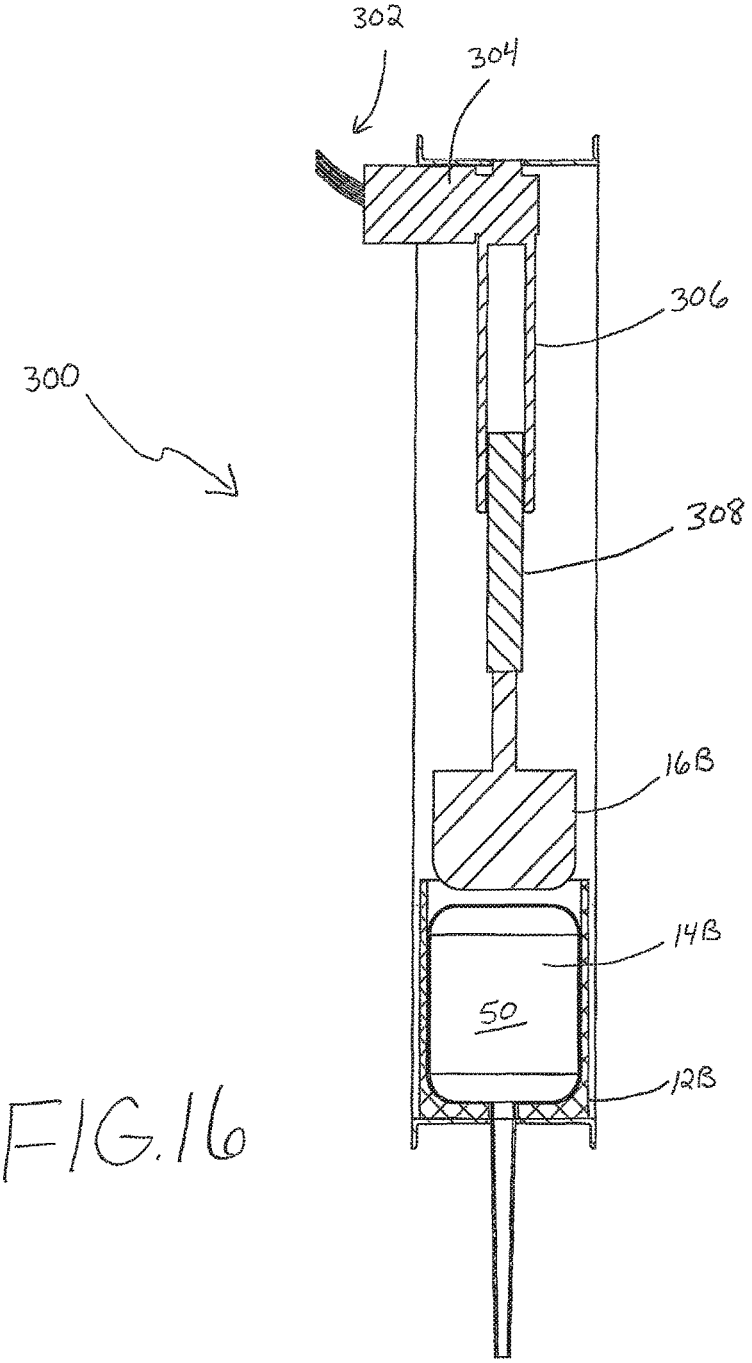
FIG. 16 is an assembled, cross-sectional view of a substance dispensing system in accordance with another embodiment of the present invention.

The embodiment illustrated in FIG. 16 includes similar components to the embodiment illustrated in FIGS. 1-10, and the similar components are denoted by a reference number followed by the letter B. For the sake of brevity, these similar components and the similar steps of using substance dispensing system 300 (FIG. 16) will not all be discussed in conjunction with the embodiment illustrated in FIG. 16. In one embodiment, electrical drive system 302 includes electric motor 304, rotational portion 306, and linear portion 308. In use, electric motor 304 provides rotary motion to rotational portion 306 which translates to axial motion of linear portion 308. In this manner, the axial motion of linear portion 308 drives actuation member 16 to advance from a first position towards a second position such that actuation member 16 deforms a container 14 to expel a substance 50 from the container 14.

Referring to FIG. 1, head portion 60 of actuation member 16 defines an actuation member diameter 68. In one embodiment, actuation member diameter 68 is less than container diameter 48 and container diameter 48 is less than confinement structure diameter 34 as shown in FIGS. 4-9. In this manner, system 10 allows for controllable deformation of a container 14 such that a portion of the container 14 acts as a wiping means to empty a substance from the container 14 as described in more detail below. In another embodiment, actuation member diameter 68 is sized to a tight tolerance with substance housing diameter 214 (FIG. 11) of substance housing 202 as shown in FIGS. 11-14. In this manner, the structural integrity of the seal between actuation member 16 and substance housing 202 is maintained such that there is no loss of substance 250 as actuation member 16 moves from the first position (FIG. 12) to the second position (FIG. 14) to contact substance 250 thereby expelling substance 250 from exit portion 212.

Referring to FIGS. 1-9, in one embodiment, actuation member 16 comprises a plunger 70. Plunger 70 includes plunger head portion 72 having a proximal wall 74, a distal wall 76, and a plunger sidewall 78 extending between proximal wall 74 and distal wall 76. In one embodiment, plunger sidewall 78 has a constant diameter between proximal wall 74 and distal wall 76 to control deformation of a container 14 such that a portion of the container 14 acts as a wiping means to empty a substance from the container 14 as described in more detail below.

Referring to FIGS. 5-8, dispensing valve 150 is placed in communication with container 14. In such an embodiment, dispensing valve 150 is operable between an open position (FIGS. 5, 7, and 8) in which a substance 50 is able to flow out container 14 and a closed position (FIG. 6) in which substance 50 is maintained within container 14 as will be described in more detail below.

Referring to FIGS. 1-16, confinement structure 12 can be configured with actuation member 16 to provide a system 10 that allows for controllable deformation of a container 14 such that a portion of the container 14 acts as a wiping means to empty a substance from the container 14. For example, confinement structure 12 and actuation member 16 could be part of a substance dispensing system in accordance with the confinement structure and the actuation member described in the United States Patent Application filed concurrently herewith, entitled "Container and Substance Dispensing System", and commonly assigned with the present application, the entire disclosure of which is hereby expressly incorporated herein by reference.

Referring to FIGS. 1-16, hydraulic drive system 100 having a hydraulic pressure includes a hydraulic cylinder 102, a hydraulic reservoir 104 containing a hydraulic fluid 106, a hydraulic pump 108 in fluid communication with hydraulic reservoir 104, the hydraulic pump 108 operable to move hydraulic fluid 106 to hydraulic cylinder 102, a hydraulic valve 110, a hydraulic motor 112, and hydraulic lines or hoses 114. Hydraulic cylinder 102 includes a first chamber 105, a second chamber 107, and a piston 109. Hydraulic pump 108 is drivingly connected to hydraulic motor 112.

In one embodiment, hydraulic lines 114 include a first supply line 116, a second supply line 118, and a hydraulic relief line 120. Hydraulic reservoir 104 is in fluid communication with first chamber 105 of hydraulic cylinder 102 via first supply line 116. In this manner, hydraulic pump 108 is operable to move hydraulic fluid 106 to first chamber 105 of hydraulic cylinder 102 to actuate piston 109 of hydraulic cylinder 102 in a forward direction generally along arrow A (FIGS. 4-7). In this manner, hydraulic cylinder 102 advances actuation member 16 from the first position (FIG. 4) towards the second position (FIG. 7) such that actuation member 16 deforms container 14 thereby expelling substance 50 from container 14. In one embodiment, hydraulic cylinder 102 is a double acting cylinder operable in both a forward direction and a reverse direction. For example, hydraulic reservoir 104 is in fluid communication with second chamber 107 of hydraulic cylinder 102 via second supply line 118. In this manner, hydraulic pump 108 is operable to move hydraulic fluid 106 to second chamber 107 of hydraulic cylinder 102 to actuate piston 109 of hydraulic cylinder 102 in a reverse direction generally along arrow B (FIGS. 4-7). In this manner, hydraulic cylinder 102 returns actuation member 16 from the second position (FIG. 7) back to the first position (FIG. 4) for additional uses of substance dispensing system 10.

In one embodiment, hydraulic valve 110 includes a variable pressure setting and the hydraulic valve 110 is operable between a closed position in which hydraulic pump 108 moves hydraulic fluid 106 to hydraulic cylinder 102 via first supply line 116 and an open position in which hydraulic pump 108 moves hydraulic fluid 106 to hydraulic reservoir 104 via hydraulic relief line 120 as will be discussed in more detail below. In one embodiment, the variable pressure setting of hydraulic valve 110 is set to a predetermined setting. In another embodiment, the variable pressure setting of hydraulic valve 110 can be set at a variety of different setting values.

In one embodiment, when the hydraulic pressure of hydraulic drive system 100 reaches the variable pressure setting, hydraulic valve 110 moves to the open position in which hydraulic pump 108 moves hydraulic fluid 106 to hydraulic reservoir 104 thereby relieving a portion of hydraulic fluid 106 pumped to hydraulic cylinder 102 and stopping movement of hydraulic cylinder 102 and actuation member 16. In this manner, substance dispensing system 10 provides a hydraulic drive system 100 that recirculates hydraulic fluid 106 instead of recirculating a substance back to a container via a pump. Substance dispensing system 10 of the present disclosure allows for precise, accurate, and instantaneous control of an external force in a substance dispensing system. For example, substance dispensing system 10 of the present disclosure allows for movement of hydraulic cylinder 102 and actuation member 16 to be stopped instantaneously for precise and accurate substance flow stoppage.

Figure 10:
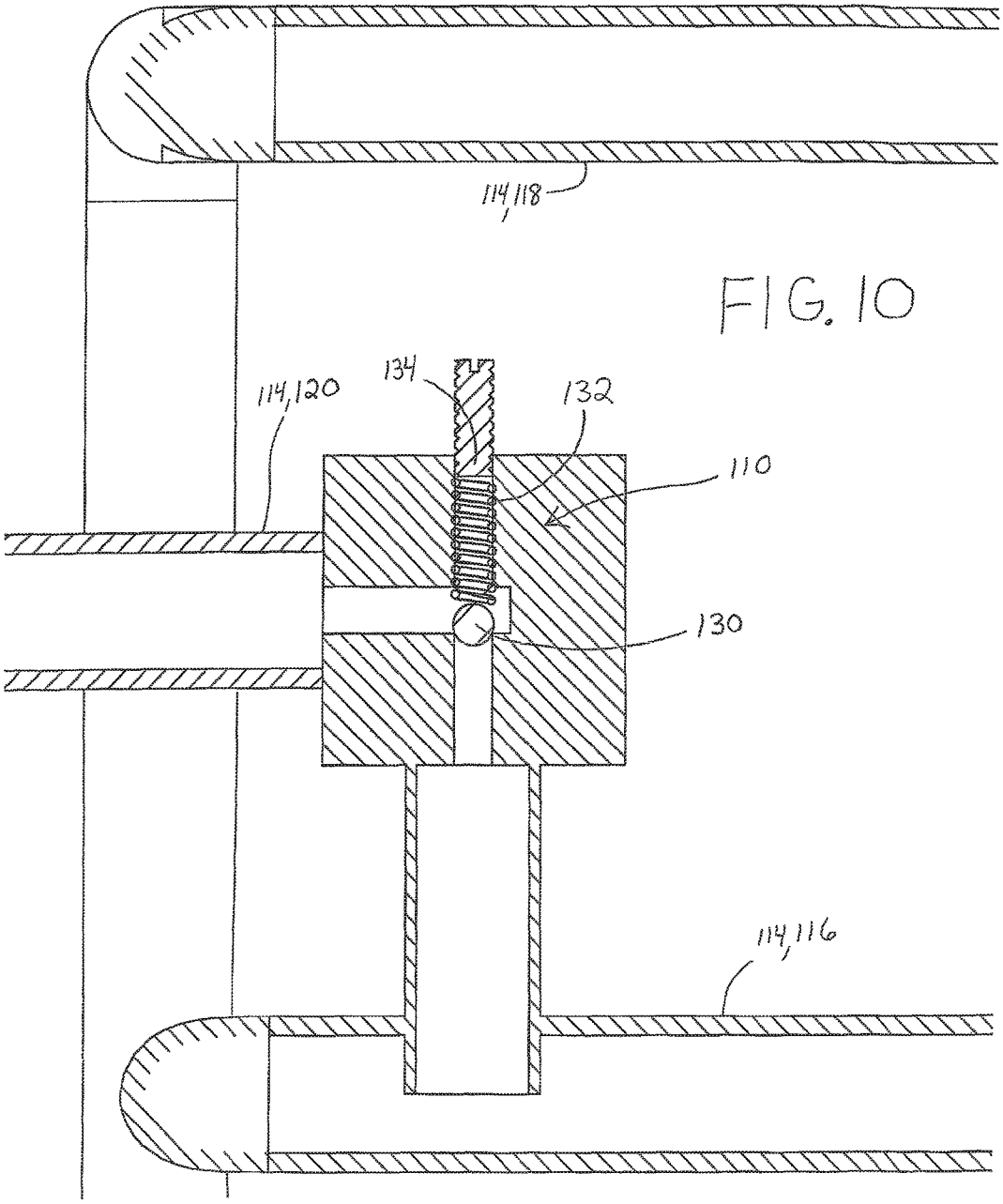
FIG. 10 is an enlarged, partial cross-sectional view of a hydraulic valve of the substance dispensing system of FIG. 3 in accordance with an embodiment of the present invention.
Figure 11:
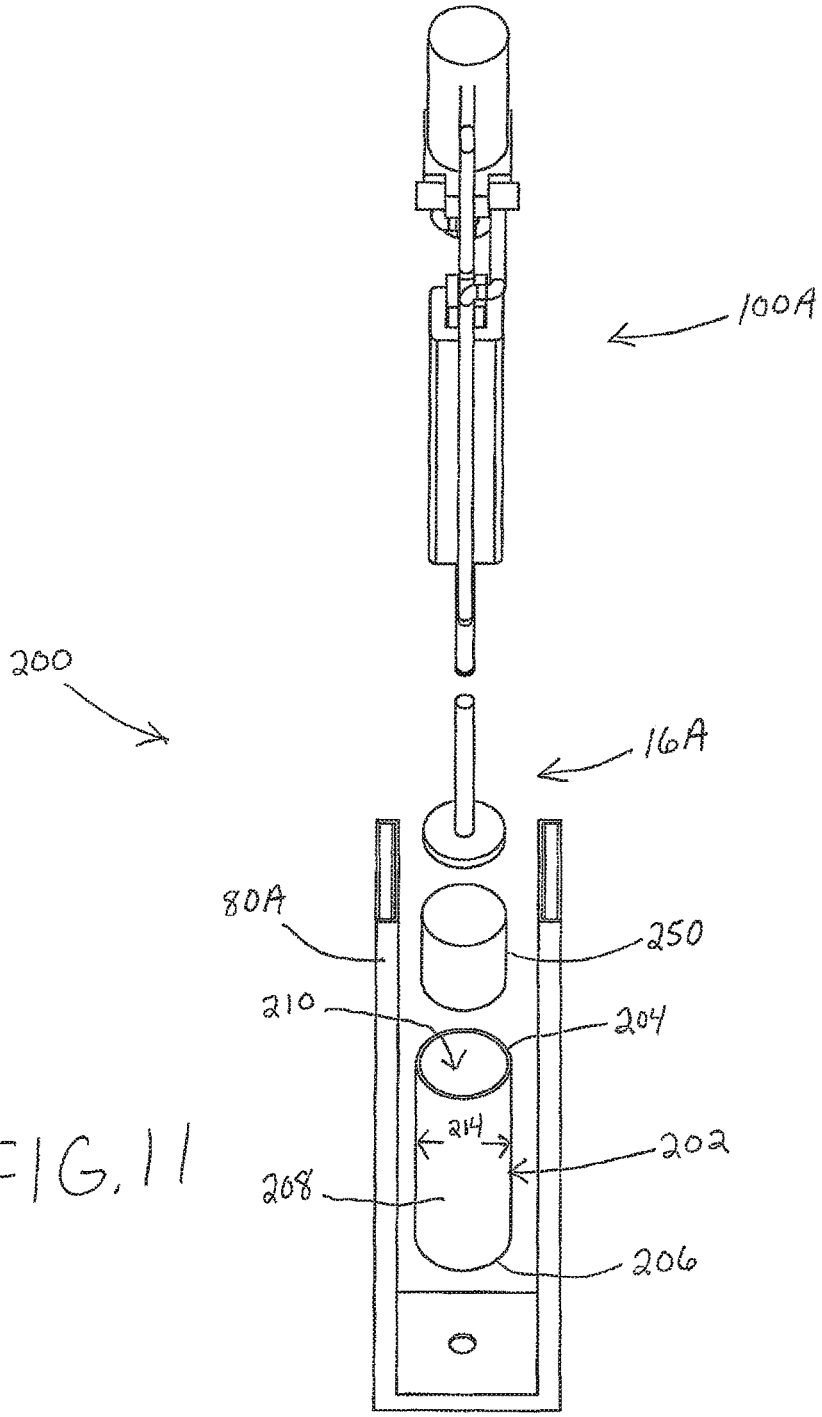
FIG. 11 is an exploded, perspective view of a substance dispensing system in accordance with another embodiment of the present invention.
Figure 12:
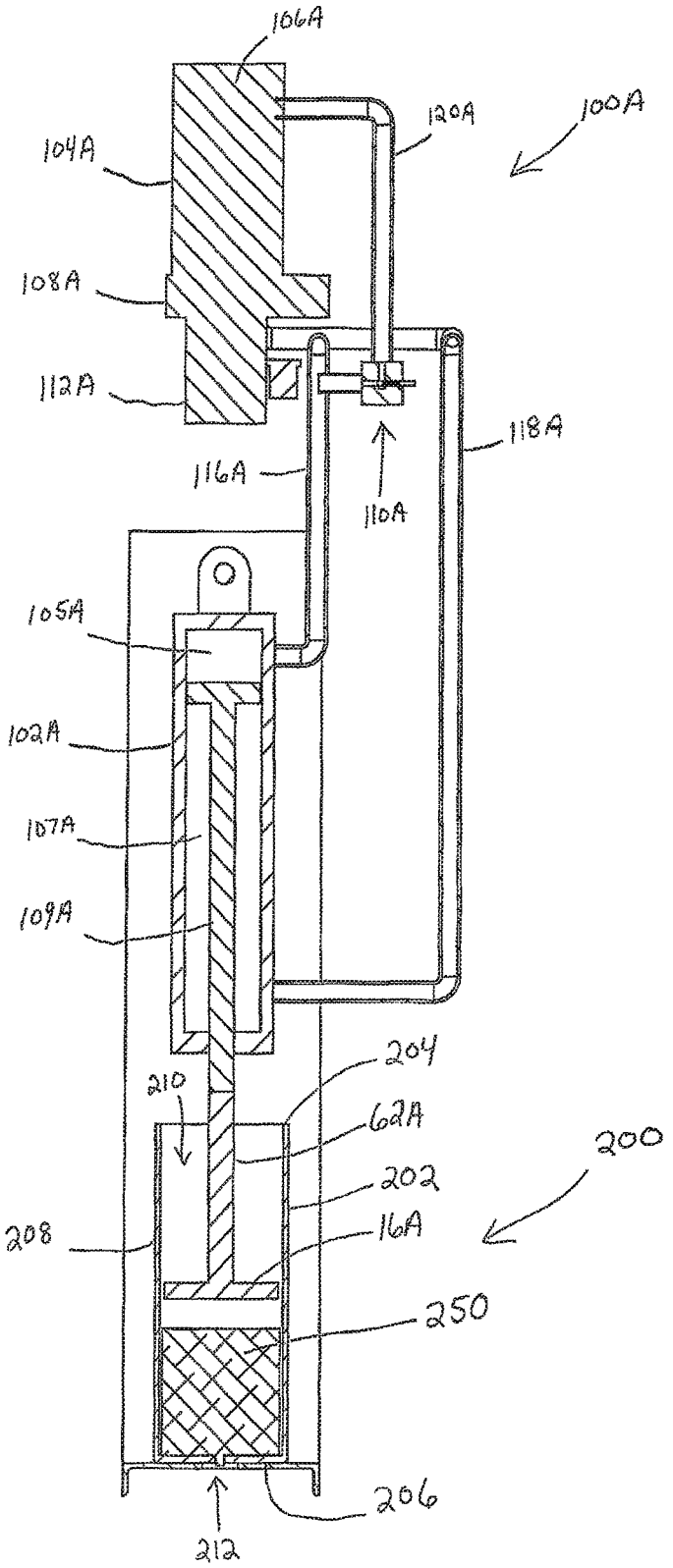
FIG. 12 is an assembled, cross-sectional view of the substance dispensing system of FIG. 11 with an actuation member in a first position in accordance with an embodiment of the present invention.

Referring to FIG. 10, in one embodiment, hydraulic valve 110 includes ball 130, spring 132, and threaded set screw 134. Spring 132 and threaded set screw 134 maintain a constant pressure on ball 130 to maintain hydraulic valve 110 in a closed position in which hydraulic pump 108 moves hydraulic fluid 106 to hydraulic cylinder 102 via first supply line 116. In other words, with hydraulic valve 110 in the closed position, ball 130 provides a valve that closes off the entrance to hydraulic relief line 120. In one embodiment, when the hydraulic pressure of hydraulic drive system 100 reaches the variable pressure setting, hydraulic valve 110 moves to the open position, i.e., the hydraulic pressure of hydraulic drive system 100 is greater than the force of spring 132 and thus the hydraulic pressure on ball 130 overcomes the force of spring 132 to move to an open position in which the entrance to hydraulic relief line 120 is opened. In this manner, hydraulic pump 108 is capable of moving hydraulic fluid 106 to hydraulic reservoir 104 thereby relieving a portion of hydraulic fluid 106 pumped to hydraulic cylinder 102 and stopping movement of hydraulic cylinder 102 and actuation member 16. In one embodiment, hydraulic valve 110 may include a poppet valve. However, it is envisioned that other valves may be used. For example, hydraulic valve 110 could include other pressure relief valves, ball valves, or similar relief valves.

Figure 15:
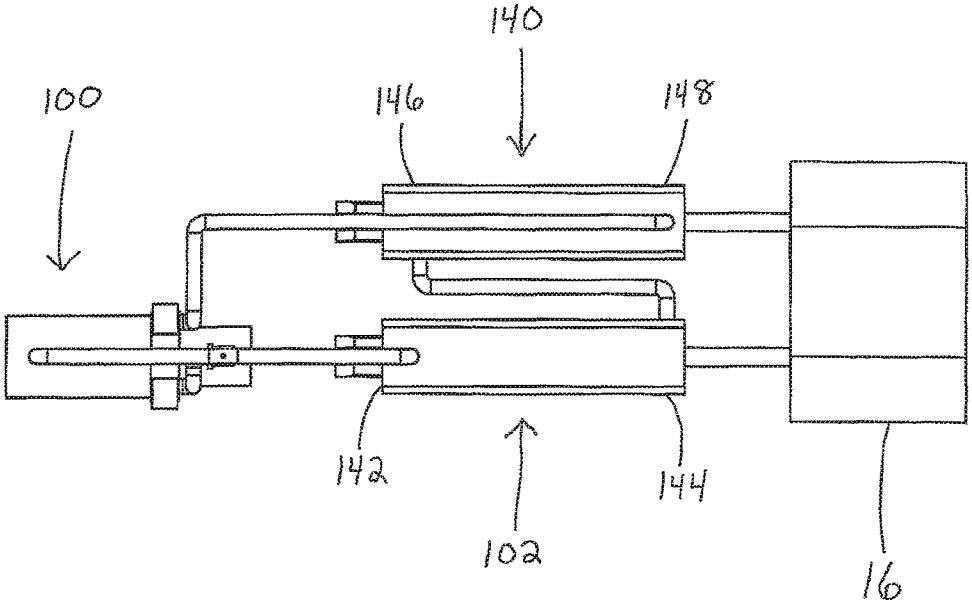
FIG. 15 is an assembled, perspective view of a substance dispensing system having a first and second hydraulic cylinder in accordance with another embodiment of the present invention.

Referring to FIG. 15, in one embodiment, hydraulic drive system 100 includes a first hydraulic cylinder 102 as discussed above, and also includes a second hydraulic cylinder 140. First hydraulic cylinder 102 includes first end 142 and second end 144 and second hydraulic cylinder 140 includes first end 146 and second end 148. In such an embodiment, with actuation member 16 in the first position (FIG. 4) and hydraulic pump 108 activated, the hydraulic pump 108 moves hydraulic fluid 106 to the first hydraulic cylinder 102 to actuate the first hydraulic cylinder 102 and simultaneously moves hydraulic fluid 106 at second end 144 of first hydraulic cylinder 102 to a first end 146 of second hydraulic cylinder 140 such that second hydraulic cylinder 140 moves concurrently with first hydraulic cylinder 102 to advance actuation member 16 from the first position (FIG. 4) towards the second position (FIG. 7) as shown in FIG. 15.

Figure 2:
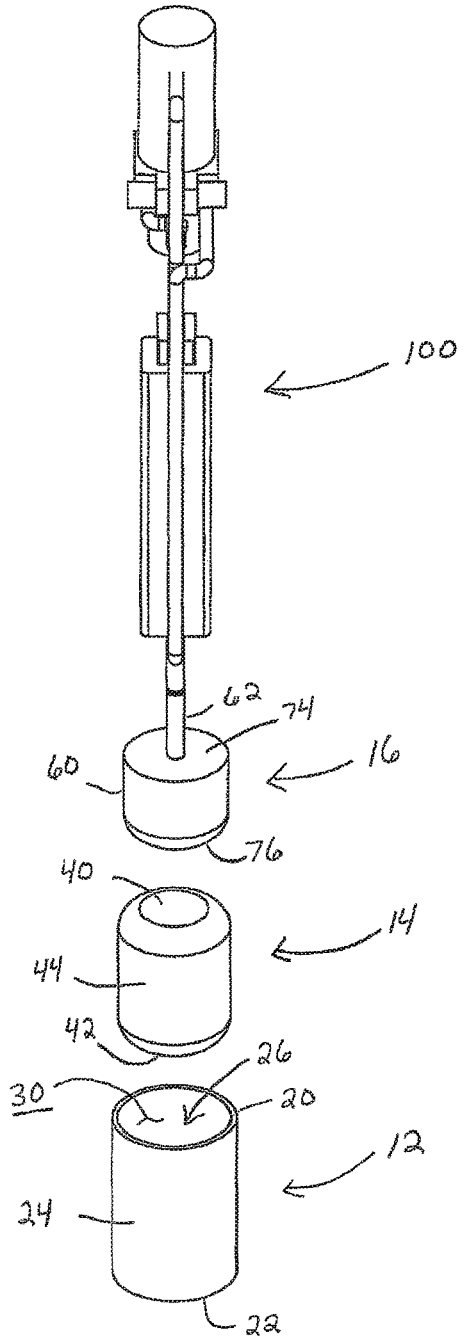
FIG. 2 is another exploded, perspective view of a substance dispensing system in accordance with an embodiment of the present invention.

Referring to FIGS. 3-9, frame 80 includes proximal end 82, distal end 84, and sidewall 86 extending between proximal end 82 and distal end 84. Sidewall 86 of frame 80 defines an interior 88 sized and shaped to receive confinement structure 12 such that confinement structure 12 is maintained in a stable position during a substance dispensing process, i.e., significant relative movement between confinement structure 12 and frame 80 is prevented. In one embodiment, proximal end 82 of frame 80 includes an open end and distal end 84 of frame 80 includes an exit portion or exit aperture 90. In an alternative embodiment, frame 80 is not utilized during a substance dispensing process as shown in FIGS. 1 and 2.

FIGS. 11-14 illustrate another exemplary embodiment of the present disclosure. The embodiment illustrated in FIGS. 11-14 includes similar components to the embodiment illustrated in FIGS. 1-10, and the similar components are denoted by a reference number followed by the letter A. For the sake of brevity, these similar components and the similar steps of using substance dispensing system 200 (FIGS. 11-14) will not all be discussed in conjunction with the embodiment illustrated in FIGS. 11-14.

Referring to FIGS. 11-14, substance dispensing system 200 includes a substance housing 202 having a first end 204, a second end 206, and a wall 208 extending therebetween and defining an interior 210 adapted to hold substance 250. In such an embodiment, substance 250 is contained within substance housing 202 at a substance pressure. In one embodiment, substance 250 is located relative to exit portion 212 and substance 250 is movable out exit portion 212 and has a substance pressure. In one embodiment, exit portion 212 is located at second end 206 of substance housing 202.

Figure 13:
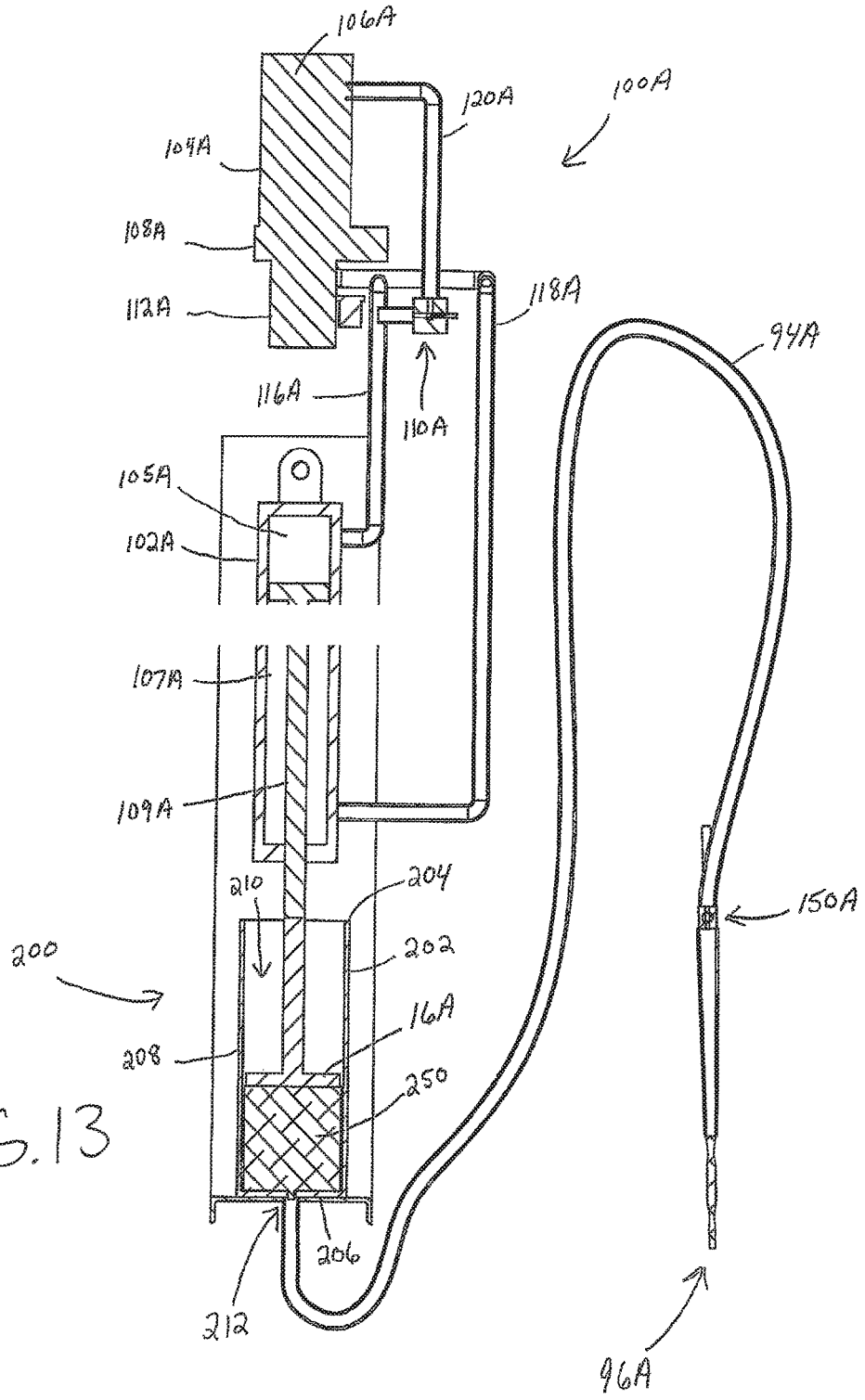
FIG. 13 is an assembled, cross-sectional view of the substance dispensing system of FIG. 11 with an actuation member in a first intermediate position in which the actuation member is in contact with a substance in accordance with an embodiment of the present invention.
Figure 14:
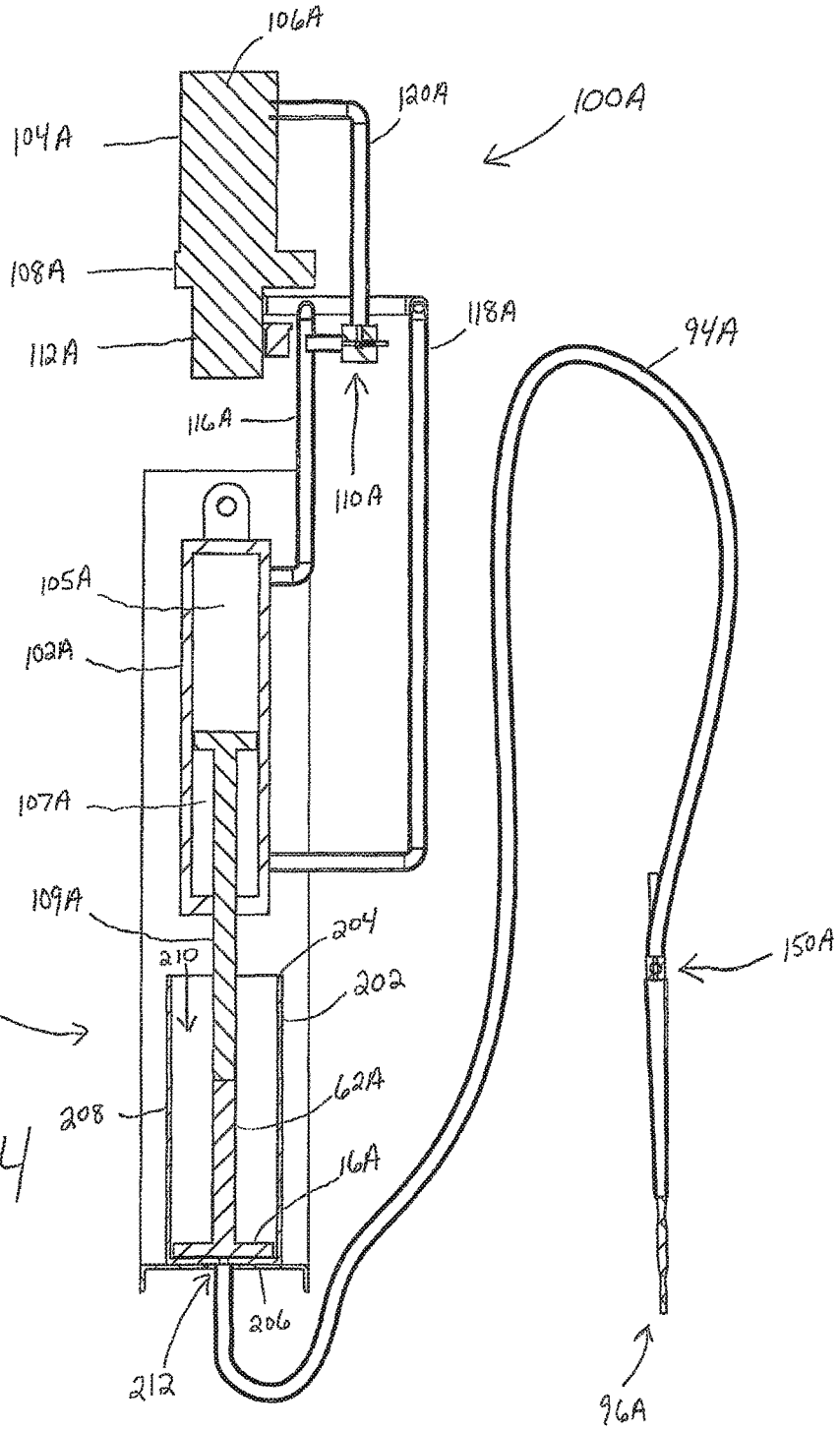
FIG. 14 is an assembled, cross-sectional view of the substance dispensing system of FIG. 11 with an actuation member in a second position in which the actuation member is in contact with a substance in accordance with an embodiment of the present invention.

In one embodiment, actuation member 16 is movably positionable relative to substance housing 202 such that with actuation member 16 in the first position (FIG. 12), the actuation member 16 is adjacent first end 204 of substance housing 202, and with actuation member 16 in the second position (FIG. 14), the actuation member 16 is adjacent second end 206 of substance housing 202. In one embodiment, with actuation member 16 in the second position (FIG. 14), substance 250 is completely expelled out exit portion 212. As actuation member 16 moves from the first position (FIG. 12) towards the second position (FIG. 14), the actuation member 16 is movably received within the interior 210 of substance housing 202 and is in contact with substance 250 as shown in FIG. 13. In one embodiment, actuation member 16 includes a plunger 70.

As discussed above, actuation member diameter 68 is sized to a tight tolerance with substance housing diameter 214 (FIG. 11) of substance housing 202 as shown in FIGS. 11-14. In this manner, the structural integrity of the seal between actuation member 16 and substance housing 202 is maintained such that there is no loss of substance 250 as actuation member 16 moves from the first position (FIG. 12) to the second position (FIG. 14) to contact substance 250 thereby expelling substance 250 from exit portion 212.

Referring to FIGS. 1-10, use of substance dispensing system 10 to recirculate hydraulic fluid in a hydraulic drive system 100 will now be described. In this manner, substance dispensing system 10 of the present disclosure allows for precise, accurate, and instantaneous control of an external force in a substance dispensing system. For example, substance dispensing system 10 of the present disclosure allows for movement of a hydraulic cylinder 102 and actuation member 16 to be stopped instantaneously for precise and accurate substance flow stoppage. For the sake of brevity, the components of substance dispensing system 10 will be referenced while describing the use of a substance dispensing system in accordance with the present disclosure as the components of substance dispensing system 300 (FIG. 16) are used in a similar manner as illustrated in FIG. 16.

Figure 4:
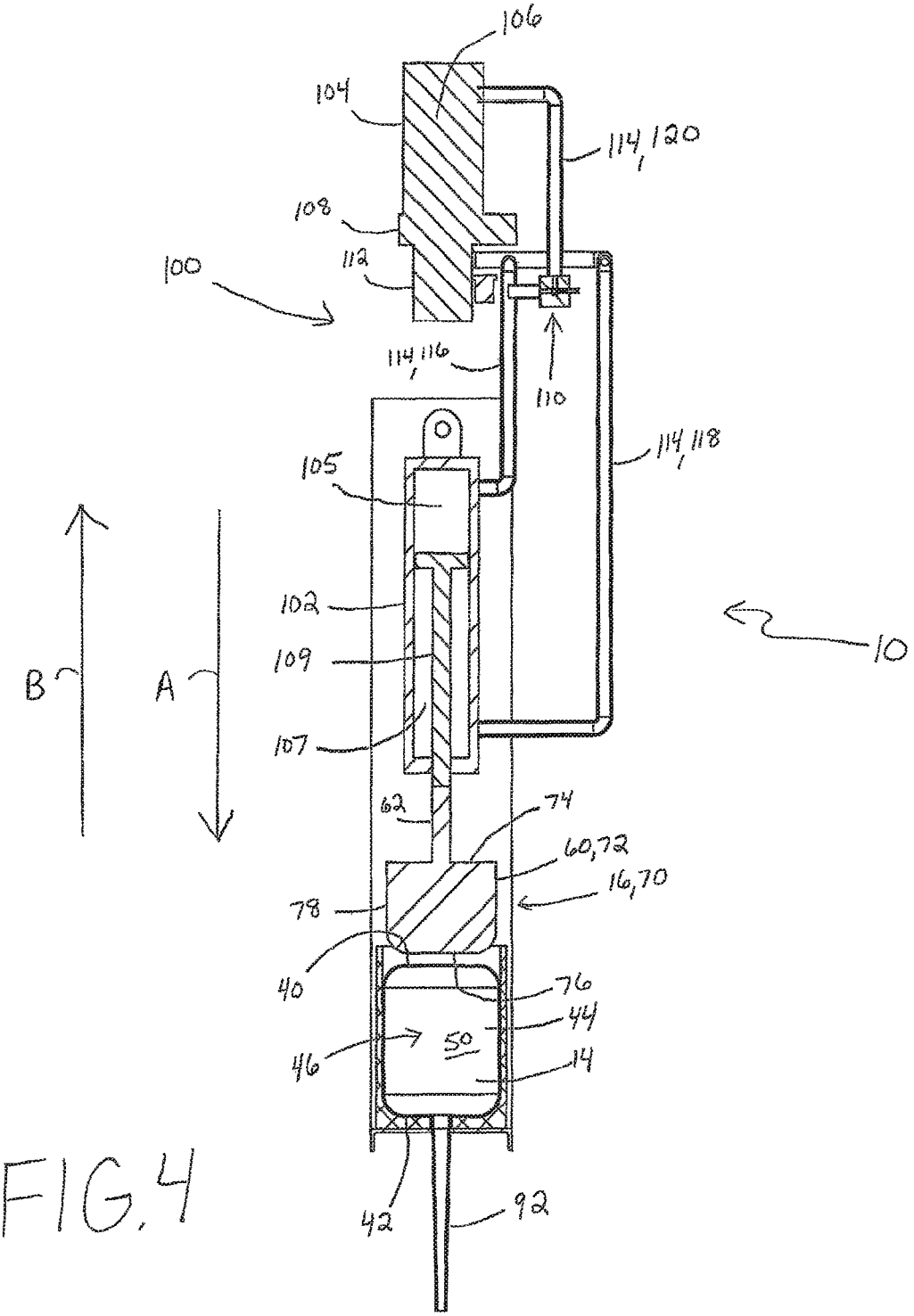
FIG. 4 is an assembled, cross-sectional view of the substance dispensing system of FIG. 3 with an actuation member in a first position in accordance with an embodiment of the present invention.

As discussed above, a variety of different containers 14 containing various substances are compatible with the substance dispensing system 10 of the present disclosure. With a particular container 14 containing a desired substance 50 to be expelled selected, the container 14 may be positioned within the interior 26 of confinement structure 12 as shown in FIG. 4.

In some embodiments, it may be desirable for the substance 50 to exit container 14 adjacent or approximately adjacent exit aperture 32 of confinement structure 12. For example, it may be desirable for the substance 50 within container 14 to be expelled from container 14 not more than approximately three (3) inches from second end 42 of container 14. When a substance 50 such as an adhesive is to be placed on small easily movable parts that are to be assembled, the parts can be moved in close proximity to the exit aperture 32. As the adhesive is expelled, it is applied to the parts being assembled and held together by the adhesive. In some embodiments, this immediate dispensing on to a part that is easily moved to the exit aperture requires no other fitment.

Figure 3:
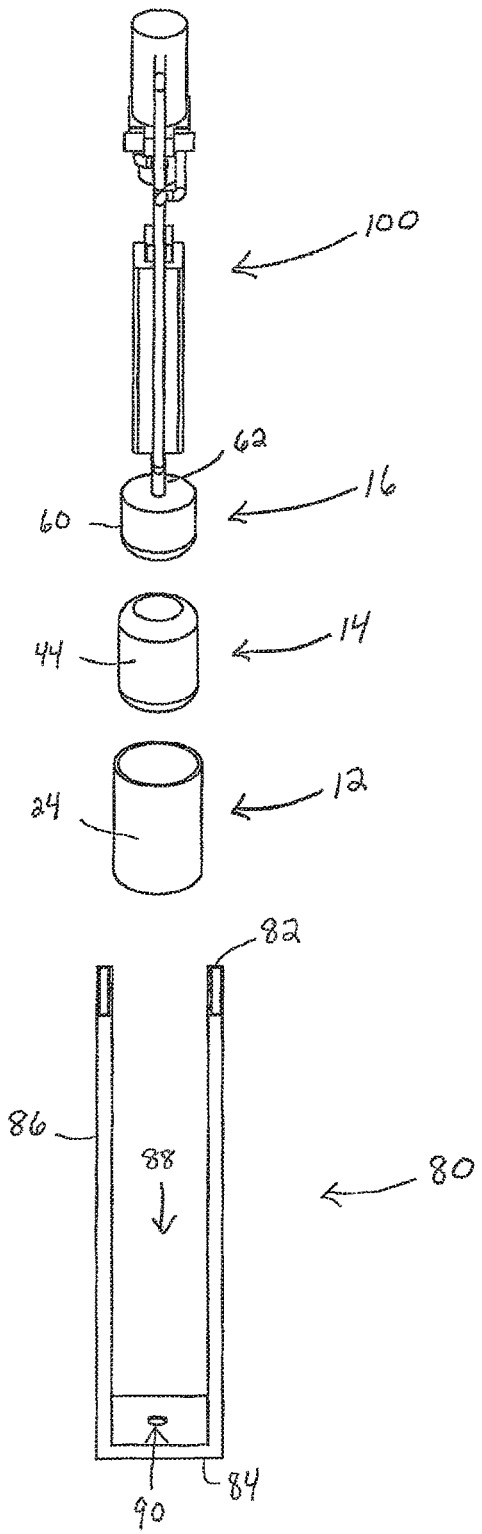
FIG. 3 is an exploded, perspective view of a substance dispensing system in accordance with another embodiment of the present invention.

In one embodiment, referring to FIGS. 1-3, a substance 50 may be expelled from container 14 and out exit aperture 32 of confinement structure 12. In another embodiment, referring to FIGS. 4 and 9, a nozzle 92 may be placed in communication with second end 42 of container 14. For example, when placing a substance 50 on a substrate either the substance 50 or the substrate or both must be movable and positionable to allow for the mating of the substance 50 to the substrate. When a substance 50, such as a caulking, is to be placed in an expansion joint of a concrete substrate, the location of the expansion joint is neither movable nor positionable. The components of substance dispensing system 10 can be fitted with a nozzle 92 and can be placed on a movable frame such as a wheeled cart. The cart and the substance dispensing system 10 may be situated so that the tip opening of the nozzle 92 may be placed in the opening of the expansion joint. The nozzle 92 directs the caulking to be expelled into the expansion joint opening. As the movable frame is pulled along in a direction parallel to the expansion joint, the tip of the nozzle 92 is capable of moving and/or sliding in the opening. The caulking is expelled out of the nozzle 92 and fills the expansion joint. When a smaller opening in the concrete requires less caulking, a smaller nozzle 92 with a smaller tip opening can be utilized to reduce the size of the bead diameter.

In some embodiments, it may be desirable for the substance 50 to exit container 14 and travel through a channel or flexible tubing, such as hose 94, for a distance before being dispensed as shown in FIGS. 5-8. In one embodiment, it may be desirable for the substance 50 within container 14 to be expelled from container 14 more than approximately three (3) inches from second end 42 of container 14. For example, at a construction site, it is often desirable to drill multiple holes in concrete and then fill those holes with an adhesive to hold a fastener. Placing the components of the substance dispensing system 10 and the actuating drive system to the exact location of each hole would be cumbersome. Holes are frequently required in vertical surfaces such as when mounting guardrails. It is not practical to maneuver all the components of the substance dispensing system 10 into a position to dispense adhesive into each hole. It is advantageous to attach a flexible hose, such as hose 94, to the dispensing container. The flexible tubing can be easily positioned at the exact location of each hole and thereby expel the adhesive into the hole. The present disclosure provides a substance dispensing system 10 that needs only be in the vicinity of the holes and the adhesive can then travel a distance in the tubing to reach the exact location of each hole.

In one embodiment, referring to FIGS. 5-8, a hose 94 may be placed in communication with second end 42 of container 14 such that container interior 46 is in fluid communication with an exit portion 96 of hose 94 via the hose 94. In this manner, a substance 50 may travel a desired distance away from substance dispensing system 10 before being dispensed. For example, when applying a roofing system, many adhesives and coatings are dispensed onto a large substrate. Frequently, adhesive manufacturers specify exact patterns of application for their adhesives. Insulation adhesive, for instance, must be applied in a ribbon or bead pattern with exact spacing. A common pattern requires that a 4 foot by 4 foot insulation board be adhered by placing ribbons or beads of adhesive no more than twelve (12) inches apart. Frequently, a serpentine pattern is used to place the adhesive in a continuous bead over the surface of a substrate. It is not practical to move the entire substance dispensing system 10 and the drive system in this serpentine pattern to dispense the adhesive per the manufacturers' specifications. By attaching a flexible hose 94 to the container 14, the adhesive can travel a distance from the components of the substance dispensing system 10 to the desired location. As the operator moves the exit portion 96 of hose 94 in the specified pattern, the adhesive exits the exit portion 96 and is placed in the pattern as specified. The addition of the flexible hose which requires the adhesive to travel a distance before exiting the dispensing system requires more force from the actuating member and the drive system. The increased force causes the pressure against the container interior 46 and the confinement structure 12 to increase. Prior art systems fail when this pressure is applied and the prior art systems are therefore not sufficient to perform such operations.

Referring to FIG. 4, with container 14 positioned within interior 26 of confinement structure 12, actuation member 16 may be placed relative to container 14 such that actuation member 16 is slidable or movable between a first position (FIG. 4) in which actuation member 16 is adjacent first end 40 of container 14 and a second position (FIG. 7) in which actuation member 16 is adjacent second end 42 of container 14. In one embodiment, the first position is an initial position and the second position is a position in which container 14 has been fully deformed and substance 50 has been completely expelled from container 14, i.e., substance 50 is expelled from container 14 such that no significant portion of substance 50 remains within container 14.

Figure 5:
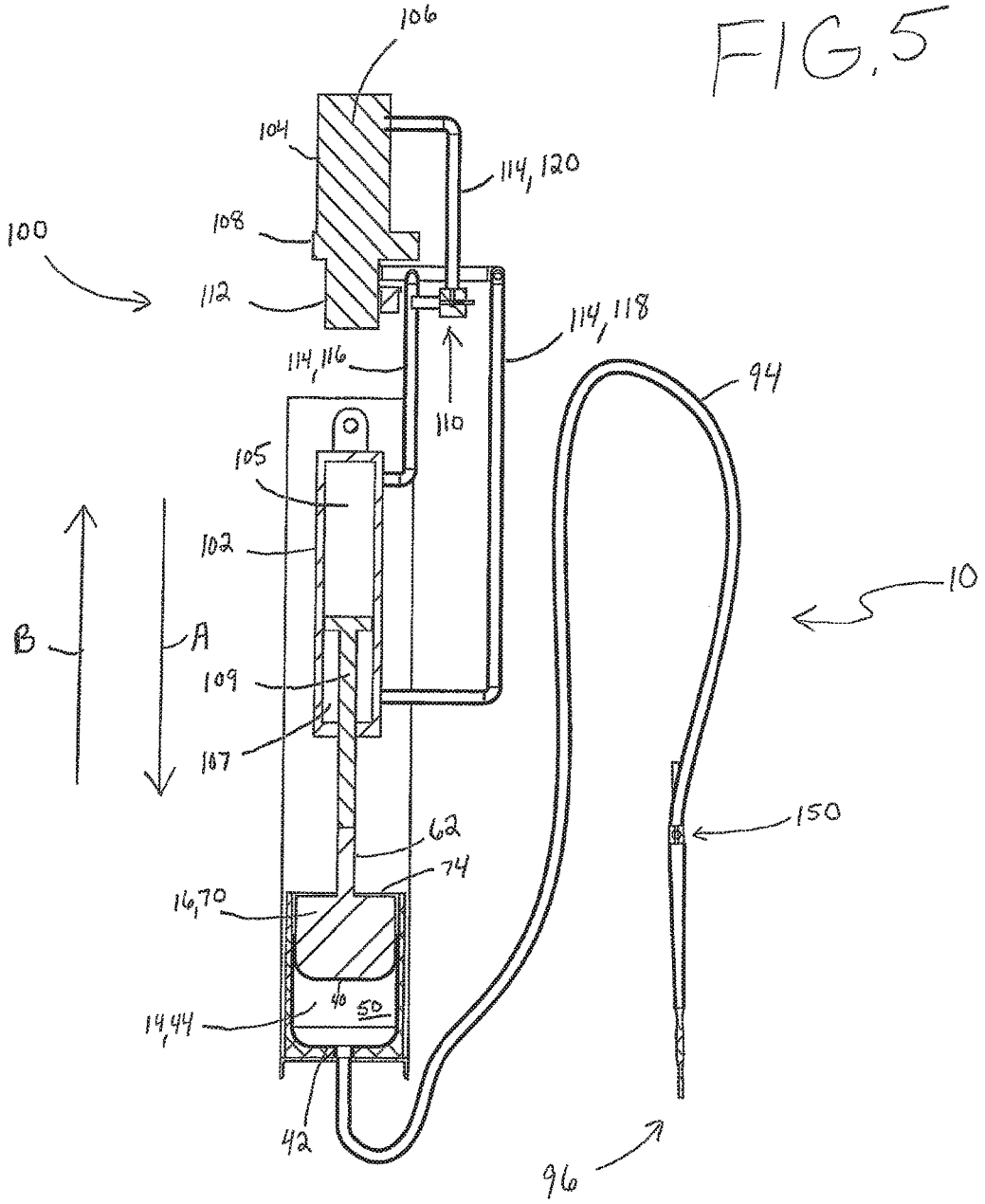
FIG. 5 is an assembled, cross-sectional view of the substance dispensing system of FIG. 3 with an actuation member in a first intermediate position deforming a portion of a container and a dispensing valve in an open position in accordance with an embodiment of the present invention.
Figure 6:
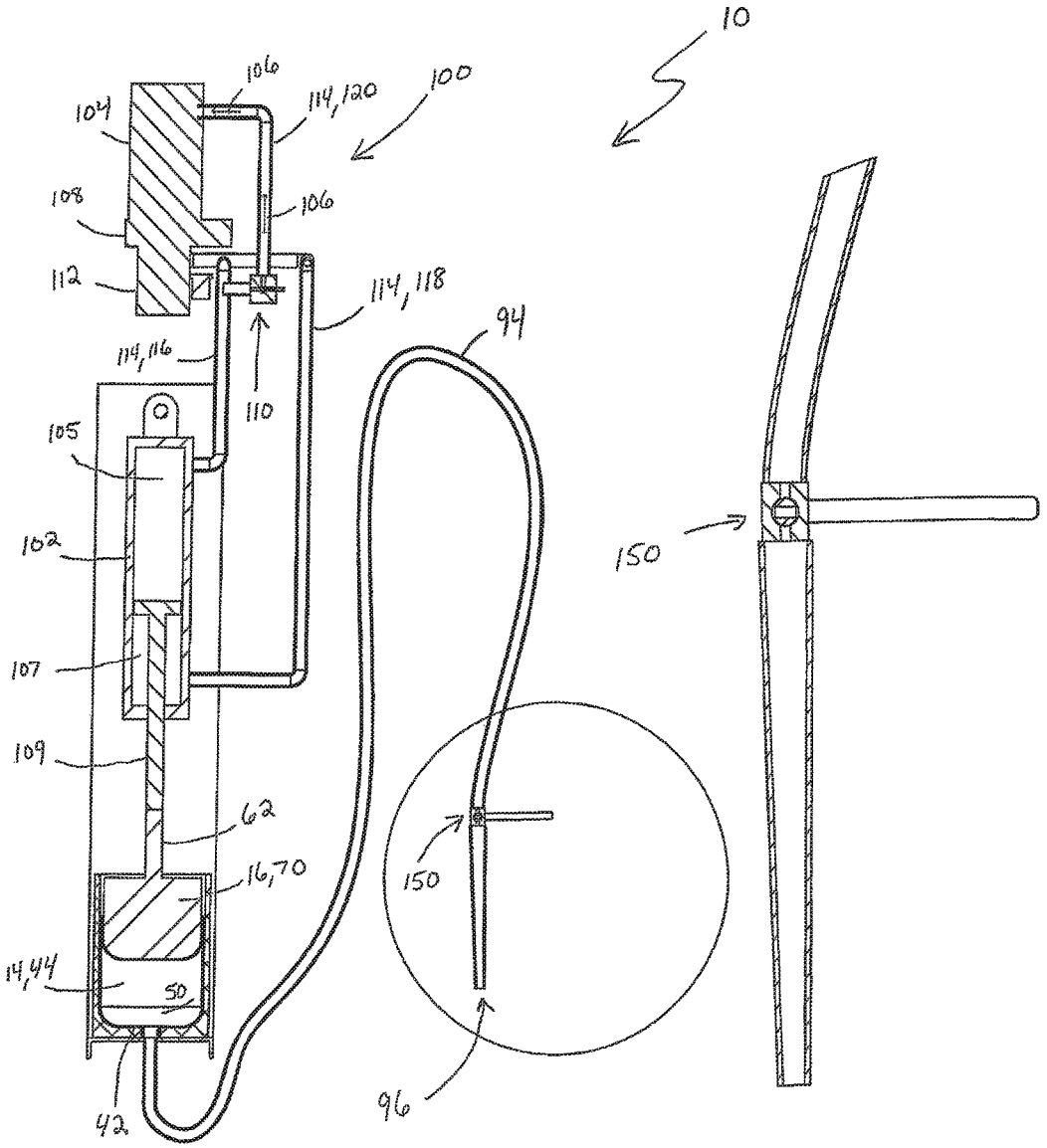
FIG. 6 is an assembled, cross-sectional view of the substance dispensing system of FIG. 3 with an actuation member in a first intermediate position deforming a portion of a container and a dispensing valve in a closed position in accordance with an embodiment of the present invention.
Figure 7:
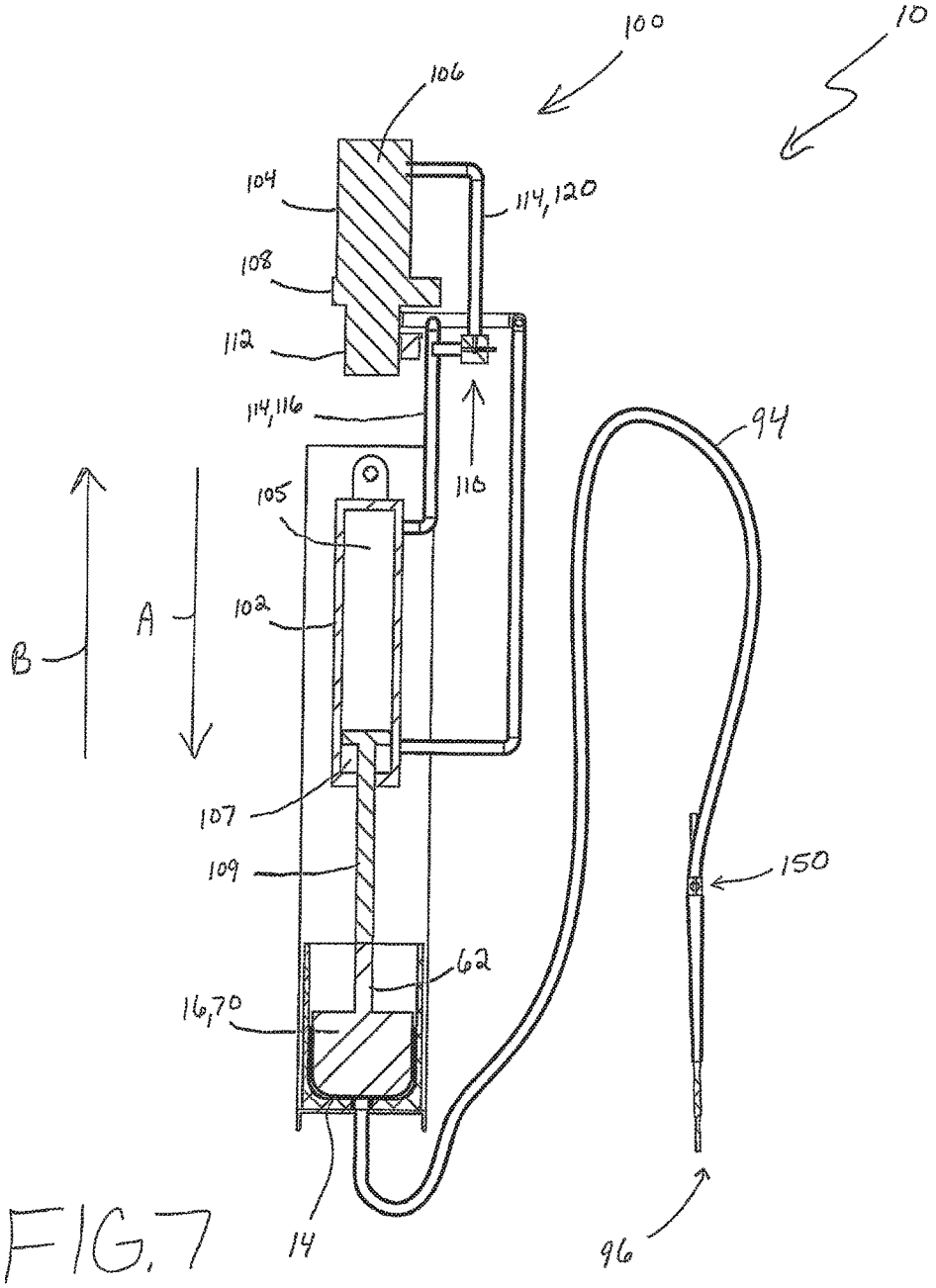
FIG. 7 is an assembled, cross-sectional view of the substance dispensing system of FIG. 3 with an actuation member in a second position deforming a portion of a container in accordance with an embodiment of the present invention.

Next, referring to FIGS. 1-10, hydraulic drive system 100 as discussed above may be used to begin advancing actuation member 16 from the first position (FIG. 4) towards the second position (FIG. 7). As actuation member 16 moves from the first position towards the second position, actuation member 16 deforms container 14 to begin expelling substance 50 from container 14. In one embodiment, dispensing valve 150 may be placed in communication with second end 42 of container 14. Dispensing valve 150 may be operable between an open position in which substance 50 is able to flow out container 14 and a closed position in which substance 50 is maintained within container 14, i.e., dispensing valve 150 stops flow of substance 50 from container 14 to provide a resistance that resists movement of actuation member 16 and hydraulic cylinder 102.

Figure 8:
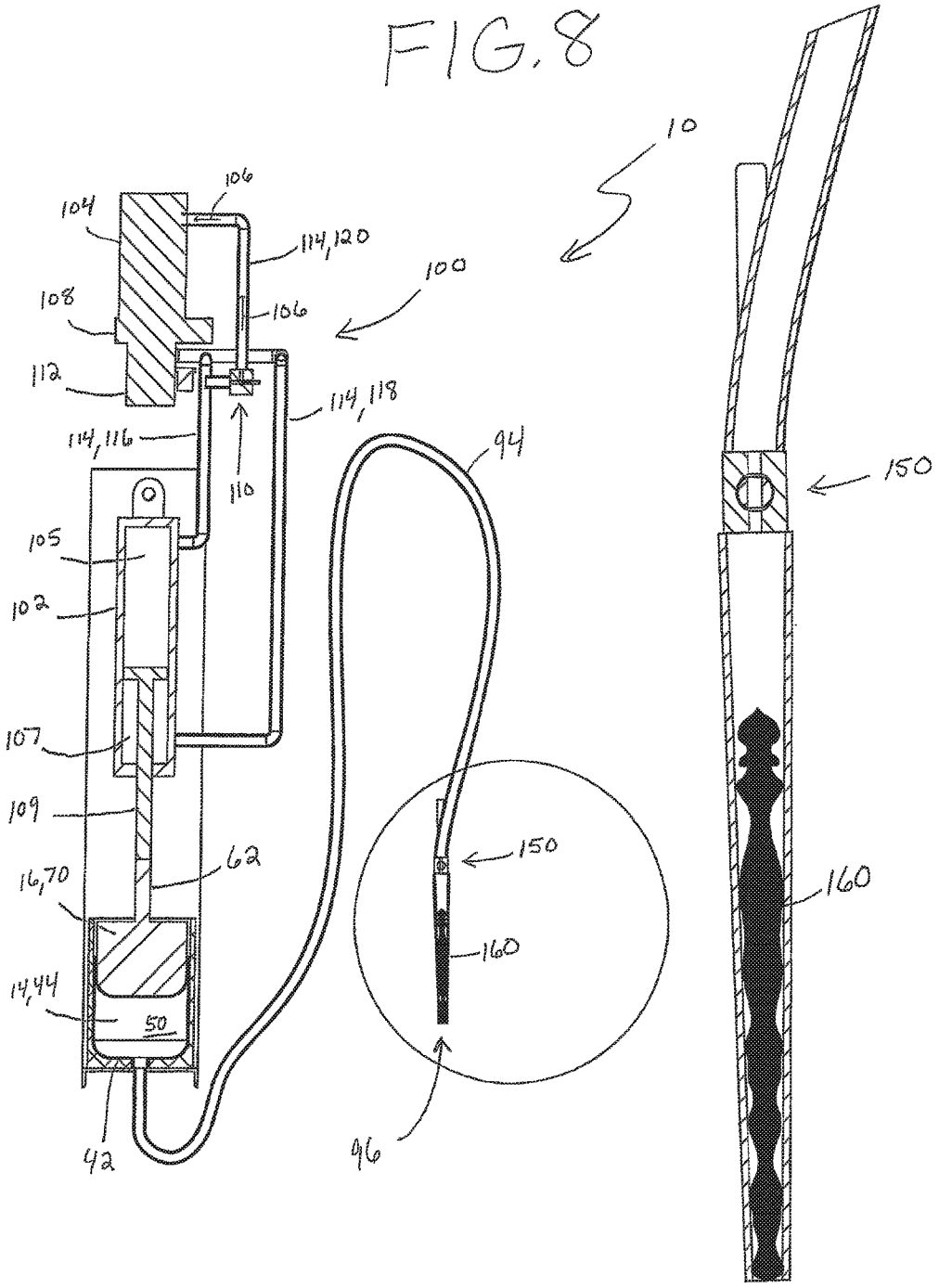
FIG. 8 is an assembled, cross-sectional view of the substance dispensing system of FIG. 3 with an actuation member in a first intermediate position deforming a portion of a container and a clog in the substance dispensing system in accordance with an embodiment of the present invention.

With actuation member 16 in the first position (FIG. 4) and hydraulic pump 108 activated, hydraulic pump 108 moves hydraulic fluid 106 to hydraulic cylinder 102 to actuate hydraulic cylinder 102 which advances actuation member 16 from the first position (FIG. 4) towards the second position (FIG. 7). Referring to FIGS. 5, 7, and 8, with dispensing valve 150 in the open position, as actuation member 16 moves from the first position towards the second position, actuation member 16 deforms container 14 thereby expelling substance 50 from container 14. Referring to FIG. 6, with dispensing valve 150 in the closed position, dispensing valve 150 provides an interruption means that interrupts the flow of substance 50 from container 14. The interruption of the flow of substance 50 from container 14 causes the substance pressure of substance 50 to increase. In this manner, substance 50 provides a resistance that resists movement of actuation member 16 and hydraulic cylinder 102 thereby increasing the hydraulic pressure of hydraulic drive system 100. When the hydraulic pressure of hydraulic drive system 100 reaches the variable pressure setting, hydraulic valve 110 moves to the open position in which hydraulic pump 108 moves hydraulic fluid 106 to hydraulic reservoir 104 via hydraulic relief line 120 thereby relieving hydraulic fluid 106 pumped to hydraulic cylinder 102 and stopping movement of hydraulic cylinder 102 and actuation member 16.

In one embodiment, moving dispensing valve 150 from the closed position to the open position allows substance 50 to flow out container 14 and reduces the substance pressure which decreases the hydraulic pressure of hydraulic drive system 100. When the hydraulic pressures drops below the variable pressure setting, the hydraulic valve 110 moves to the closed position in which hydraulic pump 108 moves hydraulic fluid 106 to hydraulic cylinder 102 to actuate hydraulic cylinder 102 which advances actuation member 16 towards the second position.

In one embodiment, with use of confinement structure 12 as shown in FIGS. 4-7, actuation member 16 is movable between the first position (FIG. 4) in which actuation member 16 is adjacent proximal end 20 of confinement structure 12 and the second position (FIG. 7) in which actuation member 16 is adjacent distal end 22 of confinement structure 12. With container 14 positioned within confinement structure 12 and hydraulic pump 108 activated, the hydraulic pump 108 moves hydraulic fluid 106 to hydraulic cylinder 102 to actuate hydraulic cylinder 102 which advances actuation member 16 from the first position towards the second position. With dispensing valve 150 in the open position, as actuation member 16 moves from the first position towards the second position, the actuation member 16 deforms container 14 thereby expelling substance 50 from container 14. With dispensing valve 150 in the closed position, the substance pressure increases and provides the resistance that resists movement of actuation member 16 and hydraulic cylinder 102 thereby increasing the hydraulic pressure of hydraulic drive system 100. In one embodiment, when the hydraulic pressure reaches the variable pressure setting, the hydraulic valve 110 moves to the open position in which hydraulic pump 108 moves hydraulic fluid 106 to hydraulic reservoir 104 via hydraulic relief line 120 thereby relieving hydraulic fluid 106 pumped to hydraulic cylinder 102 and stopping movement of hydraulic cylinder 102 and actuation member 16. In one embodiment, placing dispensing valve 150 in the closed position instantaneously stops movement of hydraulic cylinder 102 and actuation member 16

In one embodiment, an interruption means stops flow of substance 50 from container 14 to provide a resistance that resists movement of actuation member 16 and hydraulic cylinder 102 thereby increasing the hydraulic pressure of hydraulic drive system 100. In this embodiment, when the hydraulic pressure reaches the variable pressure setting, hydraulic valve 110 moves to the open position in which hydraulic pump 108 moves hydraulic fluid 106 to hydraulic reservoir 104 thereby relieving hydraulic fluid 106 pumped to hydraulic cylinder 102 and stopping movement of hydraulic cylinder 102 and actuation member 16.

Referring to FIGS. 5-8, in one embodiment, the interruption means includes dispensing valve 150 which is operable between an open position in which substance 50 is able to flow out container 14 and a closed position in which substance 50 is maintained within container 14 as discussed above.

Figure 9:
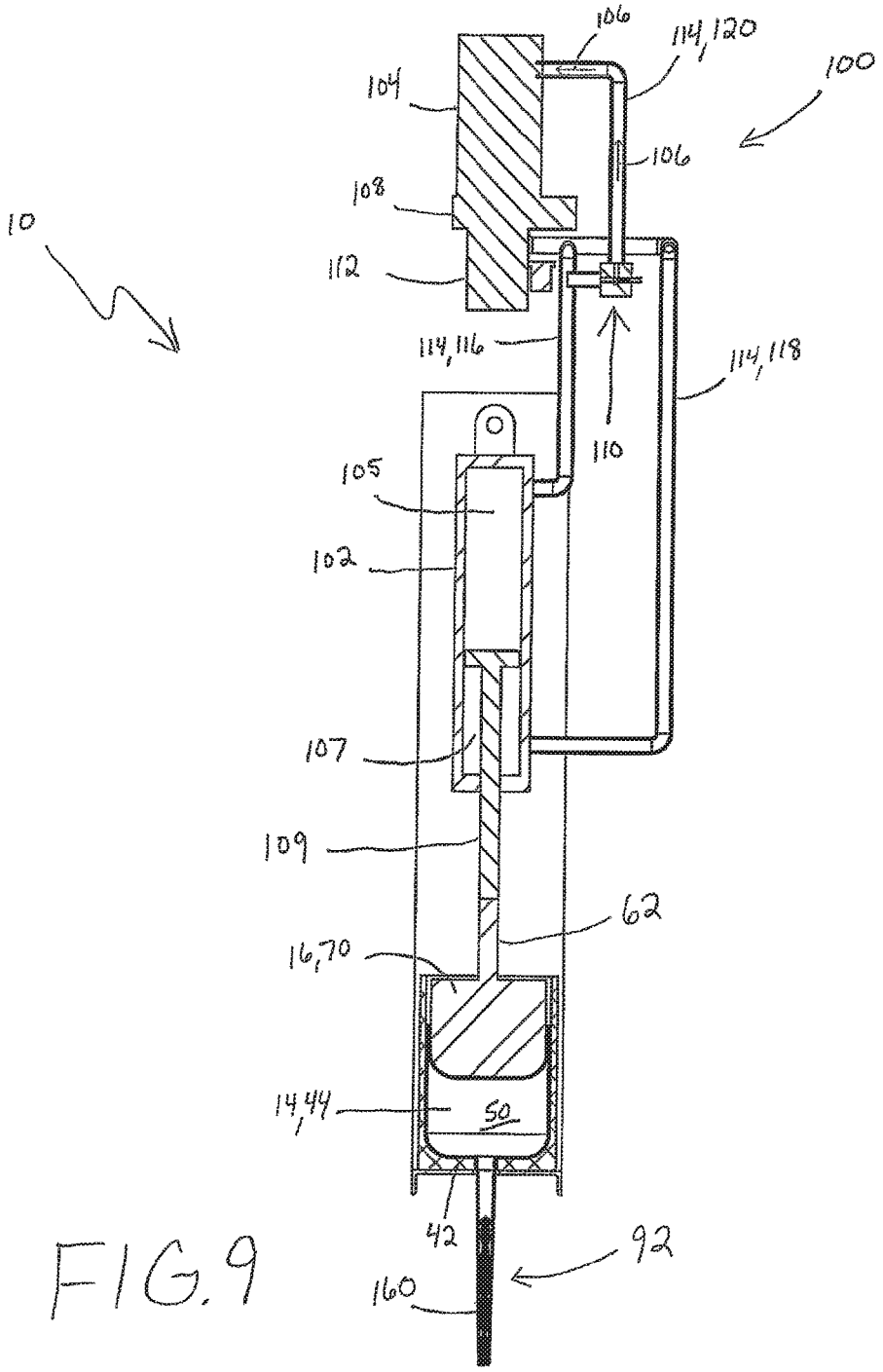
FIG. 9 is an assembled, cross-sectional view of the substance dispensing system of FIG. 3 with an actuation member in a first intermediate position deforming a portion of a container and a clog in the substance dispensing system in accordance with another embodiment of the present invention.

Referring to FIGS. 8 and 9, in one embodiment, the interruption means includes clog 160. In such an embodiment, an unintentional clog 160 in the fluid dispensing path will stop the flow of substance 50 from container 14 to provide a resistance that resists movement of actuation member 16 and hydraulic cylinder 102 thereby increasing the hydraulic pressure of hydraulic drive system 100. In this embodiment, when the hydraulic pressure reaches the variable pressure setting, hydraulic valve 110 moves to the open position in which hydraulic pump 108 moves hydraulic fluid 106 to hydraulic reservoir 104 thereby relieving hydraulic fluid 106 pumped to hydraulic cylinder 102 and stopping movement of hydraulic cylinder 102 and actuation member 16. In this manner, substance dispensing system 10 includes an added safety feature such that any unintentional clogs 160 in the fluid dispensing path will instantaneously stop movement of hydraulic cylinder 102 and actuation member 16 as discussed above.

In other embodiments, the interruption means may include anything that stops the flow of substance 50 from container 14. In this manner, the flow of substance 50 from container 14 being stopped provides a resistance that resists movement of actuation member 16 and hydraulic cylinder 102 thereby increasing the hydraulic pressure of hydraulic drive system 100. In such embodiments, when the hydraulic pressure reaches the variable pressure setting, hydraulic valve 110 moves to the open position in which hydraulic pump 108 moves hydraulic fluid 106 to hydraulic reservoir 104 thereby relieving hydraulic fluid 106 pumped to hydraulic cylinder 102 and stopping movement of hydraulic cylinder 102 and actuation member 16.

In the above-described manner, substance dispensing system 10 of the present disclosure allows for precise, accurate, and instantaneous control of an external force in a substance dispensing system. For example, substance dispensing system 10 of the present disclosure allows for movement of a hydraulic cylinder 102 and actuation member 16 to be stopped instantaneously for precise and accurate substance flow stoppage.

Referring to FIGS. 11-14, use of substance dispensing system 200 to recirculate hydraulic fluid in a hydraulic drive system 100 will now be described. In this manner, substance dispensing system 200 of the present disclosure allows for precise, accurate, and instantaneous control of an external force in a substance dispensing system. For example, substance dispensing system 200 of the present disclosure allows for movement of a hydraulic cylinder 102 and actuation member 16 to be stopped instantaneously for precise and accurate substance flow stoppage.

In this embodiment, as discussed above, substance 250 is located relative to an exit portion 212, substance 250 being movable out exit portion 212, and substance 250 having a substance pressure. Actuation member 16 is movably positionable relative to substance 250 such that actuation member 16 is movable between a first position (FIG. 12) in which actuation member 16 is adjacent substance 250 and a second position (FIG. 14) in which actuation member 16 is in contact with substance 250 and forces substance 250 out exit portion 212. With actuation member 16 in the first position and hydraulic pump 108 activated, hydraulic pump 108 moves hydraulic fluid 106 to hydraulic cylinder 102 to actuate hydraulic cylinder 102 which advances actuation member 16 from the first position towards the second position. As actuation member 16 moves from the first position towards the second position, the actuation member 16 contacts substance 250 thereby expelling substance 250 from exit portion 212.

When an interruption stops the flow of substance 250 from exit portion 212, the substance pressure is increased and substance 250 provides a resistance that resists movement of actuation member 16 and hydraulic cylinder 102 thereby increasing the hydraulic pressure of hydraulic drive system 100. In one embodiment, when the hydraulic pressure reaches the variable pressure setting, hydraulic valve 110 moves to the open position in which hydraulic pump 108 moves hydraulic fluid 106 to hydraulic reservoir 104 thereby relieving hydraulic fluid 106 pumped to hydraulic cylinder 102 and stopping movement of hydraulic cylinder 102 and actuation member 16.

An example of a substance dispensing system 10 in accordance with the present disclosure will now be discussed. In one embodiment, as discussed above, substance dispensing system 10 includes hydraulic pump 108 which moves hydraulic fluid 106 into a closed system. The closed hydraulic system responds by increasing its volumetric capacity which is made possible by advancing a hydraulic cylinder 102. As hydraulic pump 108 forcibly injects hydraulic fluid 106 into the closed hydraulic system the volumetric capacity of the hydraulic circuit expands by moving piston 109. The force of piston 109 can be calculated by knowing the hydraulic pressure and multiplying it by the area of piston 109. For example, a hydraulic pump 108 with a capacity of 3,000 pounds per square inch (hereinafter "psi") of hydraulic pressure may act on a hydraulic cylinder 102 with a 3 and ¾" inch diameter and a bore area of 10 square inches. If the full pressure of the pump's capacity were applied to the 10 square inches of the piston 109, the force generated would be 30,000 pounds.

When the force of the advancing piston 109 is applied to a surface then the pressure of the force is dispersed over the area of contact. If a plate or plunger, such as actuation member 16, is attached to the distal end of the piston 109 then the pounds per square inch is easily calculated. For example, an 8" diameter plunger plate having 50 square inches of area is acted upon by 30,000 pounds of force, then the force is being applied at a rate of 600 pounds per square inch. The present disclosure, in one embodiment, provides a substance dispensing system 10 that directs this hydraulically generated force to act upon the outside of a container 14 which holds a substance 50 to be dispensed. In one example, an 8" inch diameter container also has 50 square inches of area on the bottom end. Therefore if the hydraulic system operates at full capacity the force being applied in this example would be 600 psi. The force necessary to deform an empty container is about 2 psi or 100 pounds for an 8" diameter container. This leaves 29,900 pounds of force, or 598 psi, to act on the substance 50 to be dispensed. Many flowable substances can be dispensed at about 30 psi.

As discussed above, the use of a substance dispensing system of the present disclosure to recirculate hydraulic fluid in a hydraulic drive system 100 allows for precise, accurate, and instantaneous control of an external force in a substance dispensing system. As discussed above, a substance dispensing system of the present disclosure provides a hydraulic valve 110 that in an open position allows a hydraulic pump 108 to move hydraulic fluid 106 to hydraulic reservoir 104 via a hydraulic relief line 120. In this manner, when the pressure in the hydraulic circuit reaches the variable pressure setting, the hydraulic fluid 106 is allowed to flow into the atmospheric pressure of hydraulic reservoir 104.

In one example, a process of dispensing is discussed. A particular substance 50 may require 30 psi to be properly dispensed from a container 14. With a pressure of 30 psi at the outlet of a 15' foot hose, the pressure at the point of connection of the hose 94 to the container 14 must be 48 psi as 18 psi is lost in the transport from the container 14 to the point of dispensing, for example. This means the internal substance pressure must be at 48 psi in the container 14 for proper dispensing. In one example, the container 14 may require 2 psi to be deformed during the dispensing process. Thus, the force being applied to the 8" diameter container is 50 psi or 2,500 pounds of force over the 50 square inches of the bottom of the container 14. It can be calculated that an 8" inch plunger plate also has 50 square inches and therefore to achieve 30 psi at the dispensing end will require 2,500 pounds of force to be generated. In one example, the hydraulic cylinder 102 may have a 3¾" inch diameter and a 10 square inch bore, and thus the hydraulic pressure relief valve must be set above 250 psi of hydraulic pressure.

The container 14 and hoses 94 holding and transporting the substance 50 may be only rated at 60 psi. In this example, 60 psi multiplied by the area of the bottom of the container 14 means the force which is to be applied to the container 14 should not exceed 3,000 pounds of force. The force generating hydraulic cylinder 102 with a square inch bore area of 10 must therefore not exceed 300 psi of hydraulic pressure. In one example, with pressure relief valve 110 set at 275 psi, the hydraulic cylinder 102 will only press on the bottom of the container 14 with 2,750 pounds of force. The maximum force is 55 psi as such a force spread over the 50 square inches of the plunger plate and the bottom of the container 14. In one example, allowing for 2 psi for the deformation of the container 14, the maximum pressure inside the container will be 53 psi. In one embodiment, with the dispensing valve 150 in the open position, the substance 50 can flow out at the required 30 psi. When the dispensing valve 150 closes the pressure inside the container 14 will begin to build, and when the substance pressure reaches 55 psi the resisting force from within the container 14 is sufficient to raise the hydraulic pressure to 275 psi. As the hydraulic pump 108 continues to forcibly inject more hydraulic fluid 106 into the closed hydraulic system, the pressure relief valve 110 continues to allow the same amount of hydraulic fluid 106 to flow out of the system and into the open reservoir 104. As a result, both the container 14 and the dispensing hoses 94 maintain a safe substance pressure.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A substance dispensing system, comprising:

a drive system having a pressure, the drive system comprising:

an actuation member;

a reservoir containing a fluid;

a supply line in fluid communication with the actuation member and the reservoir;

a relief line in fluid communication with the reservoir; and a valve having a variable pressure setting, the valve operable between a closed position in which the drive system moves the fluid to the actuation member via the supply line thereby actuating the actuation member and an open position in which the drive system recirculates the fluid to the reservoir via the relief line thereby relieving the fluid moved to the actuation member and stopping movement of the actuation member;

a substance containment system in communication with the actuation member of the drive system, the substance containment system comprising:

a container adapted to hold a substance, wherein the substance is contained within the container at a substance pressure, and wherein the actuation member is movably positionable relative to the container; and an interruption means for stopping flow of the substance from the container to provide a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member.

2. The substance dispensing system of claim 1, wherein the substance containment system further comprises a dispensing valve in communication with the container, the dispensing valve operable between an open position in which the substance is able to flow out the container and a closed position in which the substance is maintained within the container.

3. The substance dispensing system of claim 2, wherein the container further comprises a first end and a second end, and the actuation member is movable between a first position in which the actuation member is adjacent the first end of the container and a second position in which the actuation member is adjacent the second end of the container.

4. The substance dispensing system of claim 3, wherein, with the actuation member in the first position and the drive system activated, the drive system moves the fluid to the actuation member via the supply line to actuate the actuation member which advances the actuation member from the first position towards the second position, with the dispensing valve in the open position, as the actuation member moves from the first position towards the second position, the actuation member deforms the container thereby expelling the substance from the container, and with the dispensing valve in the closed position, the substance pressure increases and provides a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member.

5. The substance dispensing system of claim 4, wherein moving the dispensing valve from the closed position to the open position allows the substance to flow out the container and reduces the substance pressure which decreases the pressure of the drive system, and when the pressures drops below the variable pressure setting, the valve moves to the closed position in which the drive system moves the fluid to the actuation member via the supply line to actuate the actuation member which advances the actuation member towards the second position.

6. The substance dispensing system of claim 4, wherein placing the dispensing valve in the closed position instantaneously stops movement of the actuation member.

7. A substance dispensing system, comprising:

a drive system having a pressure, the drive system comprising:

an actuation member;

a reservoir containing a fluid;

a supply line in fluid communication with the actuation member and the reservoir;

a relief line in fluid communication with the reservoir; and a valve having a variable pressure setting, the valve operable between a closed position in which the drive system moves the fluid to the actuation member via the supply line thereby actuating the actuation member and an open position in which the drive system recirculates the fluid to the reservoir via the relief line thereby relieving the fluid moved to the actuation member and stopping movement of the actuation member;

a substance containment system in communication with the actuation member of the drive system, the substance containment system comprising:

a substance located relative to an exit portion, the substance movable out the exit portion, the substance having a substance pressure, wherein the actuation member is movably positionable relative to the substance; and an interruption means for stopping flow of the substance from the substance containment system to provide a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member, wherein the actuation member is movable between a first position in which the actuation member is adjacent the substance and a second position in which the actuation member is in contact with the substance and forces the substance out the exit portion, with the actuation member in the first position and the drive system activated, the drive system moves the fluid to the actuation member via the supply line to actuate the actuation member which advances the actuation member from the first position towards the second position, as the actuation member moves from the first position towards the second position, the actuation member contacts the substance thereby expelling the substance from the exit portion.

8. The substance dispensing system of claim 7, further comprising a substance housing having a first end, a second end, and a wall extending therebetween and defining an interior adapted to hold the substance, the substance contained within the substance housing at the substance pressure.

9. The substance dispensing system of claim 8, wherein the exit portion is located at the second end of the substance housing.

10. The substance dispensing system of claim 8, wherein the actuation member is movably positionable relative to the substance housing, with the actuation member in the first position, the actuation member is adjacent the first end of the substance housing, and with the actuation member in the second position, the actuation member is adjacent the second end of the substance housing.

11. The substance dispensing system of claim 8, wherein, with the actuation member in the second position, the substance is completely expelled out the exit portion.

12. The substance dispensing system of claim 8, wherein as the actuation member moves from the first position towards the second position, the actuation member is movably received within the interior of the substance housing and is in contact with the substance.

13. A substance dispensing system, comprising:

a drive system having a pressure, the drive system comprising:

an actuation member;

a reservoir containing a fluid;

a supply line in fluid communication with the actuation member and the reservoir;

a relief line in fluid communication with the reservoir; and a valve having a variable pressure setting, the valve operable between a closed position in which the drive system moves the fluid to the actuation member via the supply line thereby actuating the actuation member and an open position in which the drive system recirculates the fluid to the reservoir via the relief line thereby relieving the fluid moved to the actuation member and stopping movement of the actuation member;

a substance containment system in communication with the actuation member of the drive system, the substance containment system comprising:

a container adapted to hold a substance, wherein the substance is contained within the container at a substance pressure, and wherein the actuation member is movably positionable relative to the container, wherein the container comprises a first end and a second end, and the actuation member is movable between a first position in which the actuation member is adjacent the first end of the container and a second position in which the actuation member is adjacent the second end of the container; and a dispensing valve in communication with the container, the dispensing valve operable between an open position in which the substance is able to flow out the container and a closed position in which the substance is maintained within the container, wherein, with the actuation member in the first position and the drive system activated, the drive system moves the fluid to the actuation member via the supply line to actuate the actuation member which advances the actuation member from the first position towards the second position, with the dispensing valve in the open position, as the actuation member moves from the first position towards the second position, the actuation member deforms the container thereby expelling the substance from the container, and with the dispensing valve in the closed position, the substance pressure increases and provides a resistance that resists movement of the actuation member thereby increasing the pressure of the drive system, and when the pressure reaches the variable pressure setting, the valve moves to the open position in which the drive system recirculates the fluid to the reservoir via the relief line thereby relieving the fluid moved to the actuation member and stopping movement of the actuation member.

14. The substance dispensing system of claim 13, wherein moving the dispensing valve from the closed position to the open position allows the substance to flow out the container and reduces the substance pressure which decreases the pressure of the drive system, and when the pressures drops below the variable pressure setting, the valve moves to the closed position in which the drive system moves the fluid to the actuation member via the supply line to actuate the actuation member which advances the actuation member towards the second position.

15. The substance dispensing system of claim 13, wherein placing the dispensing valve in the closed position instantaneously stops movement of the actuation member.

* * * * *